US006129151A

United States Patent [19]

Crotwell

[11] Patent Number: 6,129,151

[45] Date of Patent: Oct. 10, 2000

[54] APPARATUS FOR USE IN THE COMPLETION OF SUBSEA WELLS

[75] Inventor: Gerald W. Crotwell, Sugarland, Tex.

[73] Assignee: Dril-Quip, Inc., Houston, Tex.

[21] Appl. No.: 09/208,703

[22] Filed: Dec. 10, 1998

[51] Int. Cl.[7] ..... E21B 7/12; E02B 11/38

[52] U.S. Cl. ..... 166/359; 166/350; 405/195.1

[58] Field of Search ..... 166/359, 367, 166/350, 338–345, 360, 77.2; 405/195.1, 202, 224, 224.2–224.4; 175/5–7

[56] References Cited

U.S. PATENT DOCUMENTS

| | | | |
|---|---|---|---|
| 3,017,934 | 1/1962 | Rhodes et al. | 166/350 |
| 3,502,143 | 3/1970 | Petersen | 166/359 X |
| 4,216,834 | 8/1980 | Wardlaw | 175/7 |
| 4,423,983 | 1/1984 | Dadiras et al. | 405/224 X |
| 4,883,387 | 11/1989 | Myers et al. | 405/195.1 |
| 5,730,554 | 3/1998 | Mosley et al. | 405/195.1 |
| 5,819,852 | 10/1998 | Cunningham et al. | 166/345 |
| 5,960,885 | 10/1999 | Edwards et al. | 166/367 X |

OTHER PUBLICATIONS

API Recommended Practice For Design And Operation of Completion/Workover Riser Systems, API RP 17G, 42 pages, Oct. 7, 1993.

Ian Calder, New Concerns In Deepwater and Harsh Environment Coiled Tubing and Workover Riser Operations, ABB Vetco Gray Ltd., 30 pages, Aberdeen, Great Britain.

*Primary Examiner*—Dennis L. Taylor

*Attorney, Agent, or Firm*—Browning Bushman

[57] ABSTRACT

Apparatus for use in the completion and workover of a subsea well adapted for coil tubing intervention comprises a surface tree having an upper end on which a coil tubing injection unit may be mounted, a tension joint adapted to be connected to the upper end of a lower riser section extending to a subsea tree and to be suspended from a tensioning system at the surface to enable the lower riser section to be maintained in tension, an upper riser section for connection at its upper end to the surface tree and at its lower end to the tension joint, and a surface joint mounted on and surrounding the riser section in position to extend through the spider at the floor of an offshore rig. The upper riser section includes an upper portion having an upper connector intermediate the surface tree and surface joint and a lower portion having a lower connector intermediate the surface joint and tension joint, and an upper sleeve is supported by the surface joint for shifting between a lower position in which access may be had to the upper connector and an upper position extending between the surface joint and surface tree to surround the upper riser portion, and a lower sleeve is supported by the surface joint for shifting between a lower position in which access may be had to the lower riser connector and an upper position extending between the surface joint and tension joint to surround the lower riser portion.

20 Claims, 23 Drawing Sheets

FIG. 7A
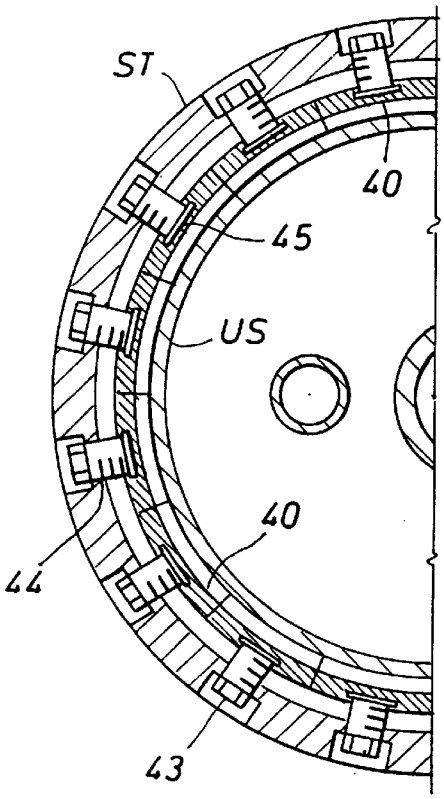
FIG. 8A
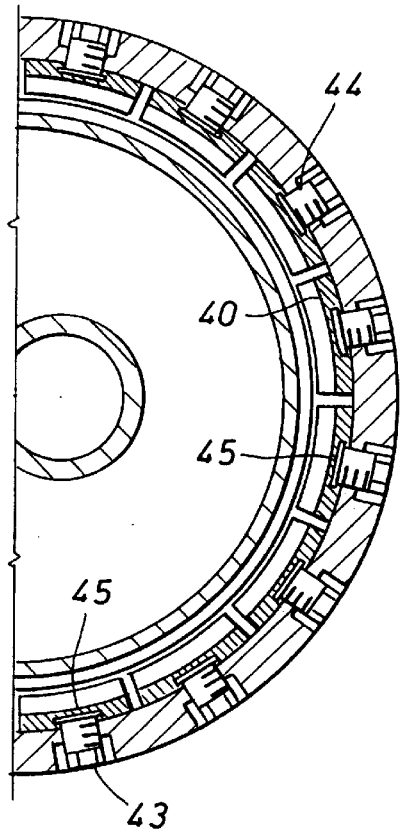
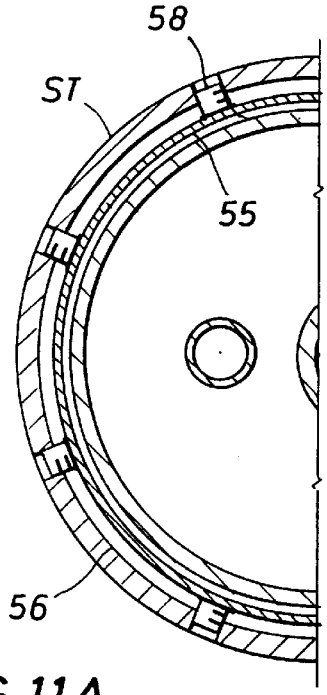
FIG. 11A
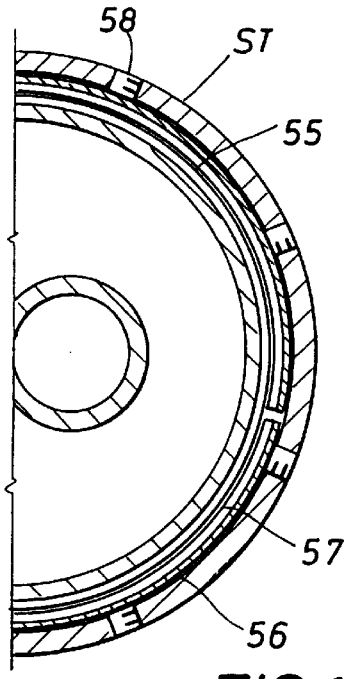
FIG. 11B

APPARATUS FOR USE IN THE COMPLETION OF SUBSEA WELLS

This invention relates generally to apparatus for use in the completion of a subsea well, and, more particularly, to improvements in apparatus of this type for use in working over as well as in completing such a well which typically includes a riser system for installing and retrieving a tubing hanger in a subsea wellhead through an outer drilling riser, and when installed on a Christmas tree above the wellhead, enabling well fluid to be produced and conveyed to the surface through one of its conduit and providing access to the annulus between the tubing and casing hangers through another conduit.

A riser system is made up of joints of riser pipe, typically forty-five feet in length, connected at end to end relation at the rig floor. In the case of a completion riser system, there are two strings of pipe, one for production fluid from the tubing in the well and the other for other fluids to be conveyed to or from the annulus between the tubing and casing strings. In the environment above described, the system typically includes a lower section having a stress joint above its lower end which is releasably connected to the subsea tree by means of a lower riser package. When remedial procedures—known as a "work over"—are to be performed on the well, a surface tree is installed on the upper section of the riser system to permit various workover tools to be lowered into and retrieved from the well, by means of wirelines or coiled tubing, while maintaining control over the well pressure.

This upper riser section includes a tension joint at the upper end of the riser string which is secured to a tensioning system at the surface in order that the lower riser section may be maintained in tension. A surface joint including an outer casing surrounds the upper riser section above the tension joint and at a position where the upper riser section extends through the floor of the drilling rig so as to protect the upper riser section from damage, and an adapter joint above the surface joint connects the upper riser section to the lower end of the surface tree. Following workover of the well, the riser system is removed and well fluids are produced through separate flow lines.

It is conventional practice to run workover tools into the well on a wireline through a so-called "snubber" which is mounted above the surface tree and which ordinarily does not impose undue weight and stress on the riser system. However, coil tubing is run through an injection unit including a blowout preventor stack, as well as an injection head above the stack, all mounted on a frame installed on the surface tree. As a whole, this equipment may be fifty feet high and weigh up to twenty tons (40,000 lbs.). As compared with a snubber, this large mass above the riser section greatly reduces the fatigue life of the upper riser section, and it is the object of this invention to provide an upper riser section which makes it possible to run the workover tools by means of coil tubing while not shortening the fatigue life of the upper riser section and, at the same time, enabling access to upper and lower connectors on the ends of the riser joints as those of the upper riser section are made up or broken out.

There are occasions, in the completion of a subsea well, in which a tubing hanger must be run though a relatively smaller riser. In this case, the surface joint must have an O.D. smaller than during the procedures above described. It is therefore a further object of this invention is to provide apparatus of the type described which is particularly well suited for use in running the tubing hanger with relatively minor modification.

These and other objects are accomplished, in accordance with the illustrated embodiments of the invention by apparatus which includes, as in prior apparatus of this type, a surface tree having an upper end on which a coil tubing injection unit may be mounted, a tension joint adapted to be connected to the upper end of a lower riser section extending to a subsea tree and adapted to be suspended from a tensioning system at the surface, and an upper riser section for connection at its upper end to the surface tree and at its lower end to the tension joint. As above described, the apparatus further includes a surface joint mounted on and surrounding the riser section in position to extend through the spider at the floor of an offshore rig. More particularly, the upper riser section typically includes an upper portion having an upper connector intermediate the surface tree and surface joint and a lower portion having a lower connector intermediate the surface joint and tension joint.

In accordance with one novel aspect of the present invention, an upper sleeve is carried about the surface joint for shifting between a lower position in which access may be had to the upper riser connector, and an upper position extending between the surface joint and the surface tree to surround the upper riser portion, and a lower sleeve is carried about the surface joint for shifting between an upper position in which access may be had to the lower riser connector and a lower position extending between the surface joint and the tension joint to surround the lower riser portion. The sleeves thus cooperate with the surface joint to render the upper riser section sufficiently sized to support a coiled tubing/workover unit without excessive fatigue damage. At the same time, when the upper and lower sleeves are in their lower and upper positions, respectively, the upper and lower connections may be made up or disconnected. On the other hand, when in their upper and lower positions, the sleeves cooperate with the surface joint to lend rigidity and thus resistance to cyclic stress due to the workover unit in the upper riser section which increases it fatigue life beyond that heretofore experienced.

In the preferred and illustrated embodiments of the invention, means are provided on the upper end of the upper sleeve and lower end of the surface tree for supporting the upper sleeve in its upper position and on the lower end of the lower sleeve and upper end of the tension joint for supporting the lower sleeve in its lower position, and on the upper end of the upper sleeve and upper end of the surface joint for supporting the upper sleeve in its lower position, and means are provided on the lower end of the lower sleeve and lower end of the surface joint for supporting the lower sleeve in its upper position.

In one embodiment of the invention, the means for supporting the upper sleeve in its upper position comprises threads on the upper sleeve engagable with threads on the surface tree, and the means for supporting the upper sleeve in its lower position comprises threads on the upper sleeve engagable with threads on the surface joint. Preferably, the threads on the upper end of the upper sleeve are formed on its inner and outer diameters for engagement with threads on the surface joint and surface tree, respectively. The means for supporting the lower sleeve in its lower position comprises threads on the lower sleeve engagable with threads on the tension joint, and the means for supporting the lower sleeve in the upper position comprises threads on the lower sleeve engagable with threads on the surface joint, together with a shoulder on the upper end of the lower sleeve for seating on a shoulder on the lower end of the surface joint as the threads on its lower end are made up with threads on the tension joint.

Additionally, there is a shoulder on the upper end of the surface joint for supporting the upper sleeve in its upper position. As shown, this shoulder is formed on a ring which is removably connected to a head which surrounds the upper riser section on the upper end of the upper sleeve. Removal of the ring fascilitates assembly of the lower end of the ring over the head.

In another embodiment of the invention, the means for supporting the upper sleeve in its upper position comprises radially expandable and contractible locking means carried by the surface tree and grooves in the sleeve to receive the locking means, and the means for supporting the upper sleeve in its lower position comprises threads on the sleeve engagable with threads on the surface joint. The means for supporting the lower sleeve in its lower position comprises radially and expandable and contractible locking means carried by the lower sleeve and grooves in the tension joint to receive the locking means, and the means for supporting the lower sleeve in its upper position comprises locking means carried by the lower sleeve for engagement in grooves on the tension joint. Also, as in the first described embodiment, the means for supporting the lower sleeve in its lower position also comprises a shoulder on the sleeve for seating on a shoulder on the surface tree as the threads on its lower end are made up with the threads on the lower end surface joint. For purposes to be described, the shoulder on the lower end of the surface joint may be a ring surrounding the lower riser section and releasably connected to the head on the lower end.

As illustrated, the locking means of these other embodiments may comprise circumferentially spaced locking segments, or, alternatively, a split ring.

As illustrated, the surface joint preferably comprises an outer tubular member fixed to the heads to each end through which the production and auxiliary lines of the upper riser section extend. The upper sleeve has means on its lower end to which a lifting line may be attached, and the lower sleeve has means on its upper end to which a lowering line may be attached. The lower end of the upper sleeve has a swivel to which the lifting line may be attached in order to lift the upper sleeve into engagement with the lower end of the upper ring, and allow rotation of the upper sleeve. The upper end of the lower sleeve has a swivel to which the lowering line may be attached in order to lower the lower sleeve onto the upper end of the lower ring and allow rotation of the lower sleeve.

The upper sleeve of each embodiment has one or more openings through which visual access may be had to the upper connection in its upper position, and the lower sleeve has one or more openings through which access may be had to the lower connection in its lower position.

In the drawings, wherein like reference characters are used throughout to designate like parts:

FIG. 1 a diagrammatic and labeled view of the upper riser section of a riser system extending downwardly from the lower end of a surface tree on which the coil tubing unit is mounted;

FIGS. 2A, 2B, and 2C are vertical sectional views of the upper, intermediate, and lower portions of the upper riser section constructed in accordance with the first described embodiment of the present invention, with the upper and lower sleeves shown in their upper and lower positions, respectively;

FIGS. 2AA, 2BB, and 2CC are views similar to FIGS. 2A, 2B, and 2C, but in which the upper sleeve is lowered and the lower sleeve raised to allow access to the upper and lower connectors.

FIGS. 3A, 3B, and 3C are enlarged vertical sectional views of the upper riser section with the upper and lower sleeves in the position of FIGS. 2A, 2B, and 2C;

FIGS. 3AA, 3BB, and 3CC are also enlarged vertical sectional views, but with the sleeves in the positions of FIGS. 2AA, 2BB, and 2CC;

Figure 3A:
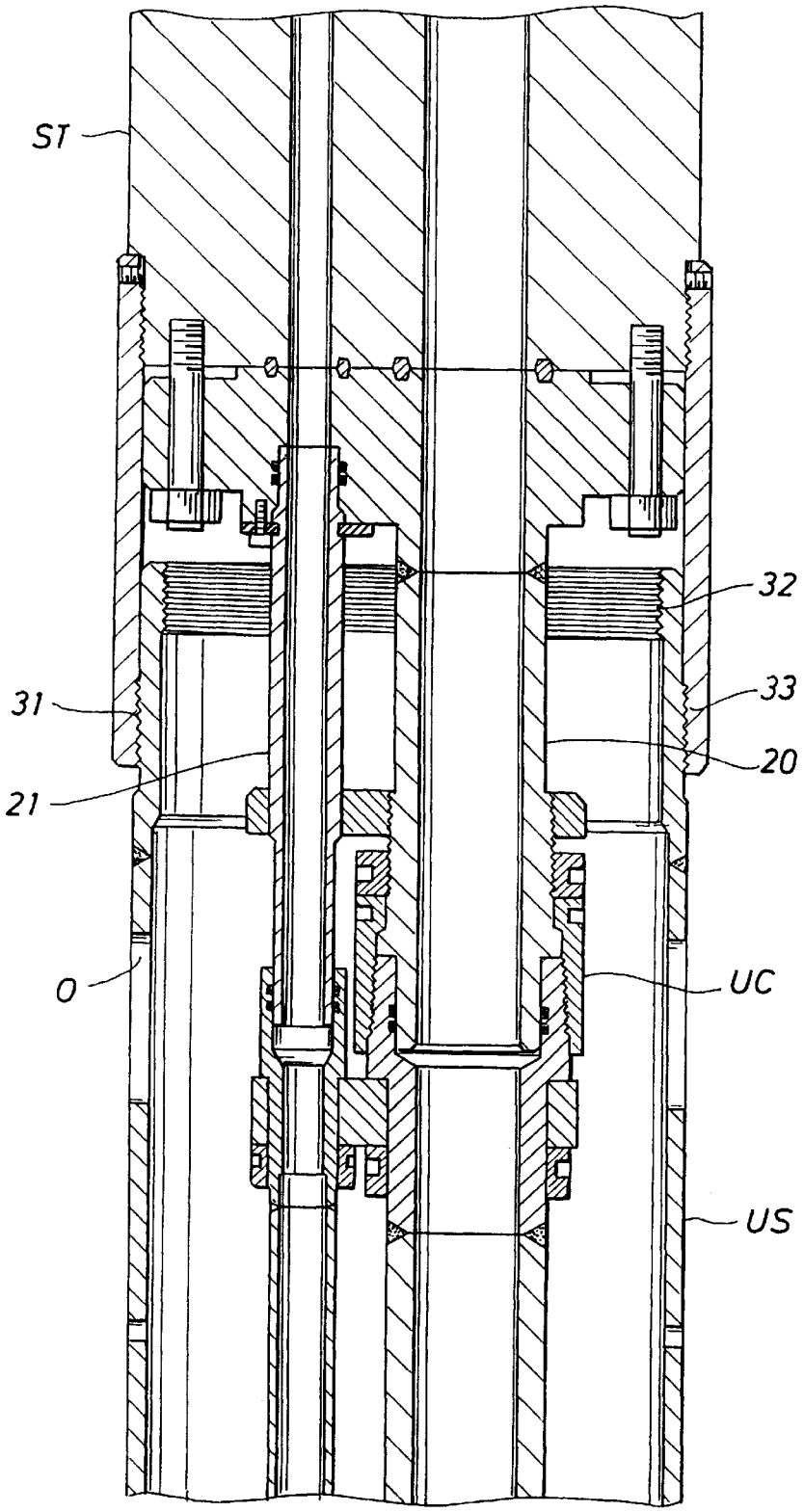
Figure 3A:
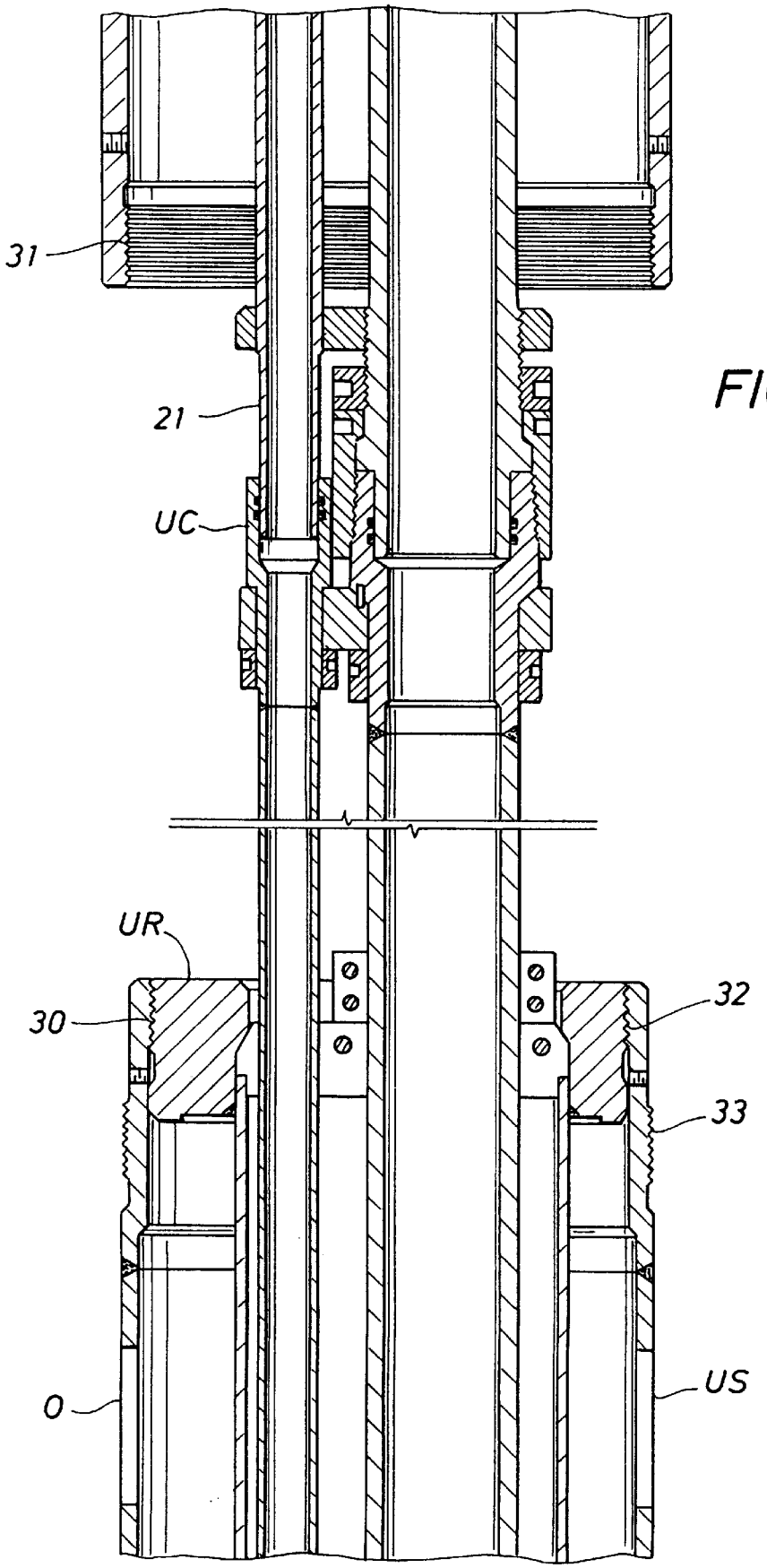
Figure 3B:
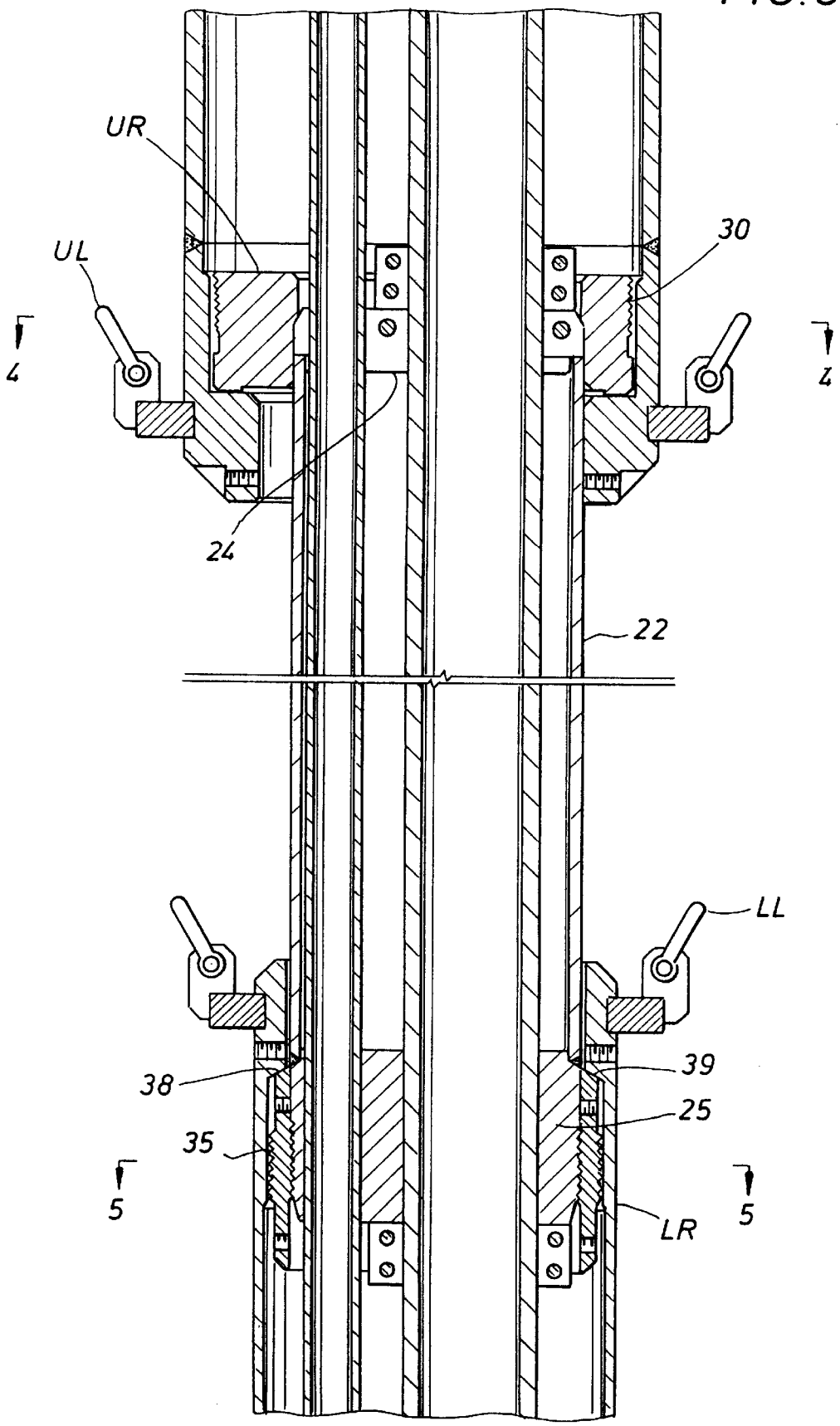
Figure 3B:
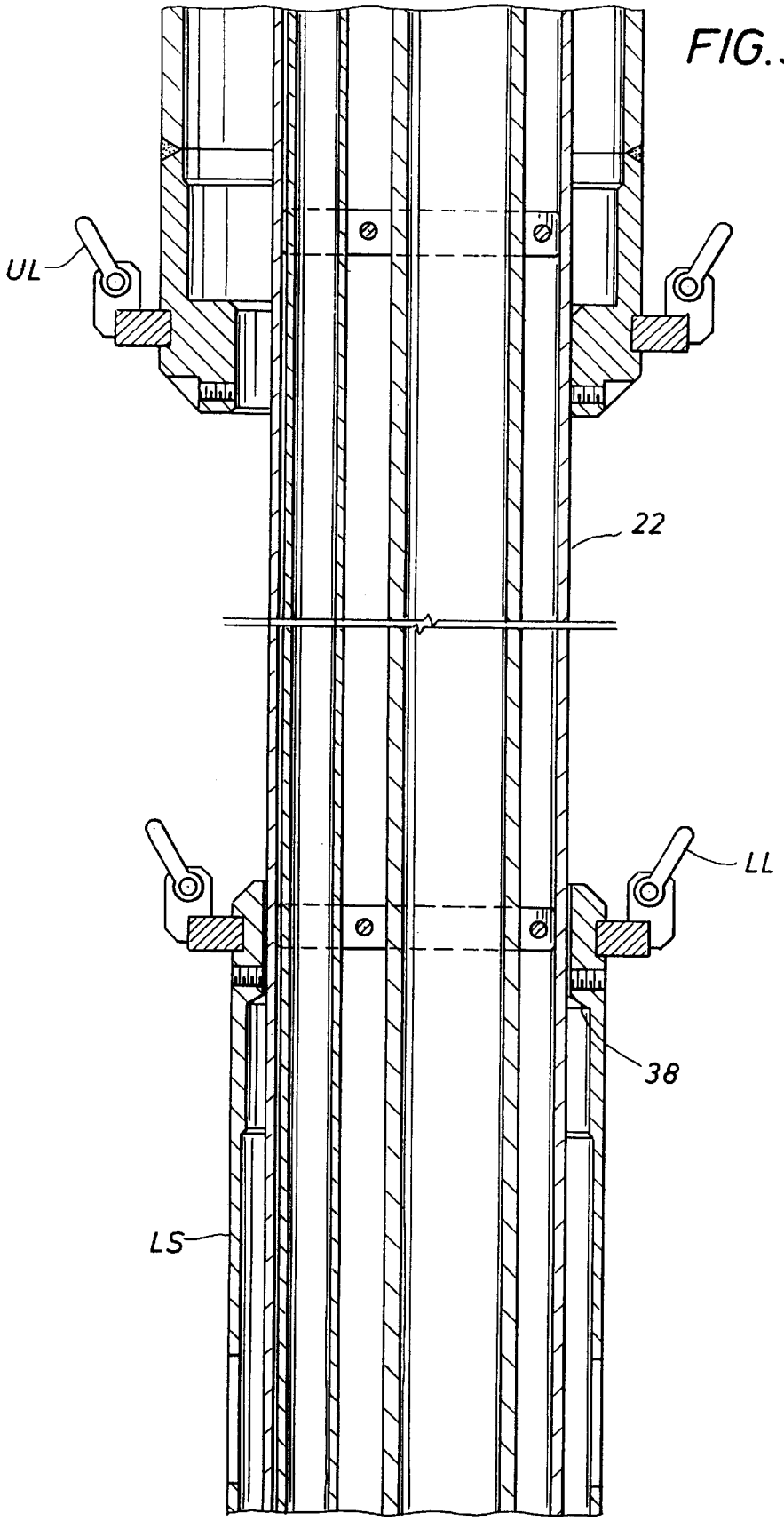
Figure 3C:
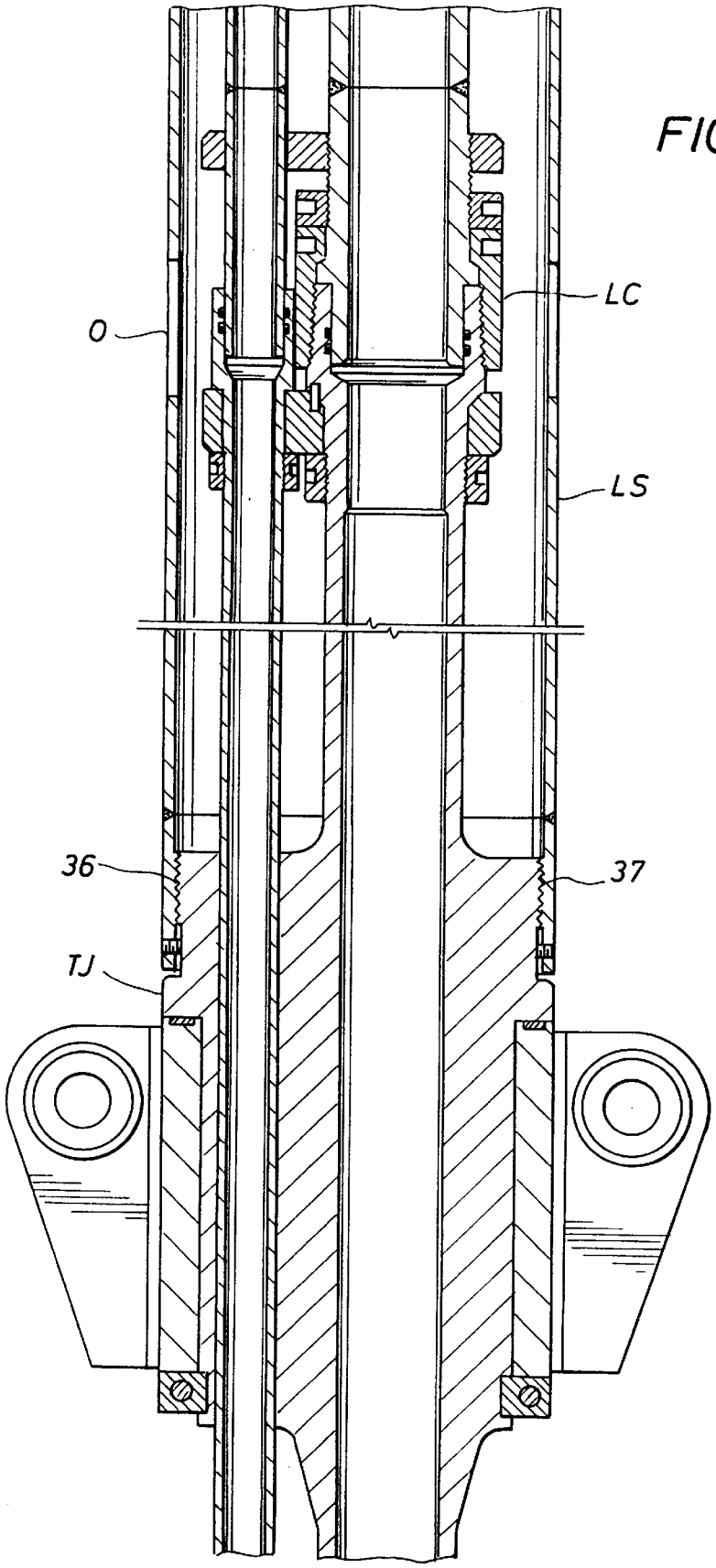
Figure 3C:
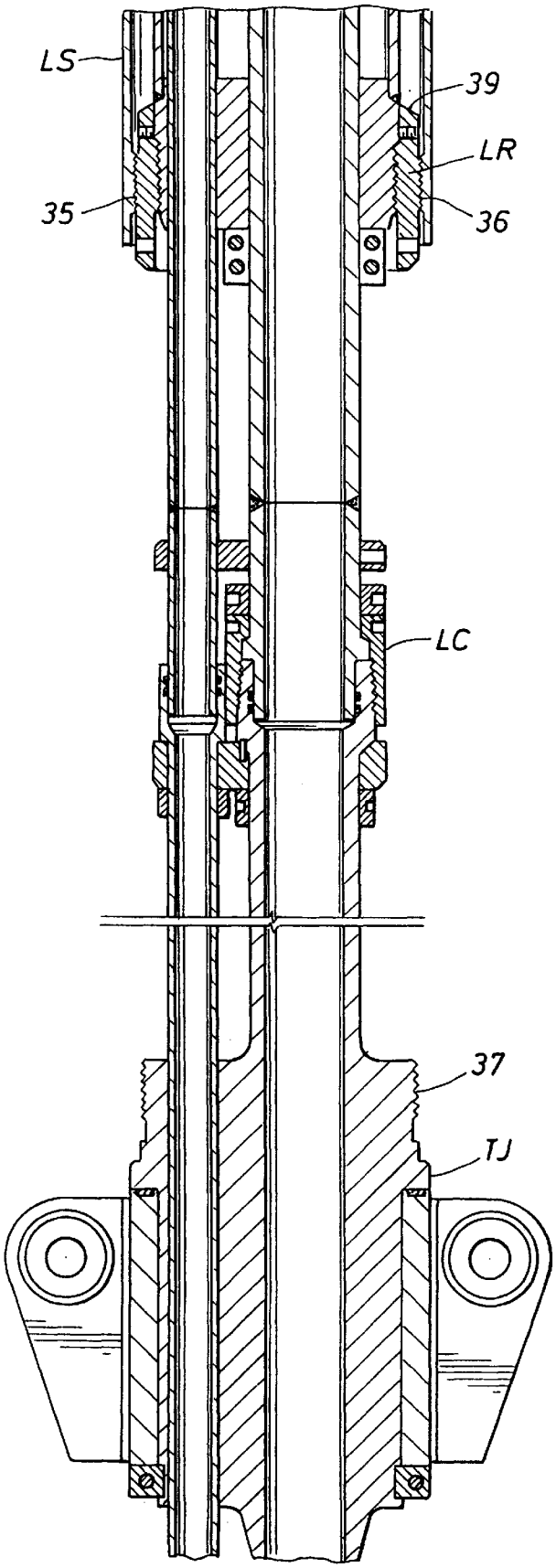
Figure 6A:
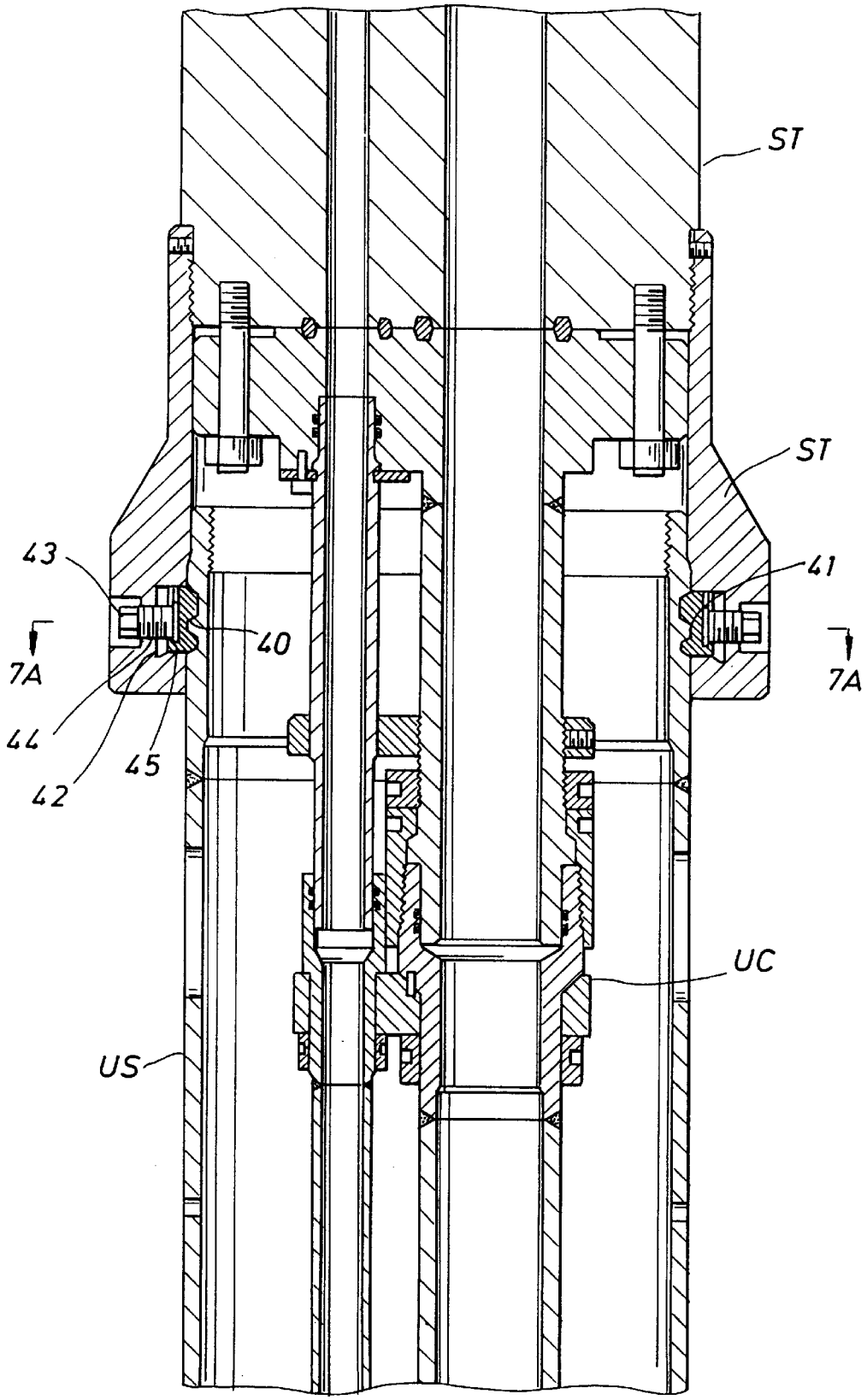
Figure 6A:
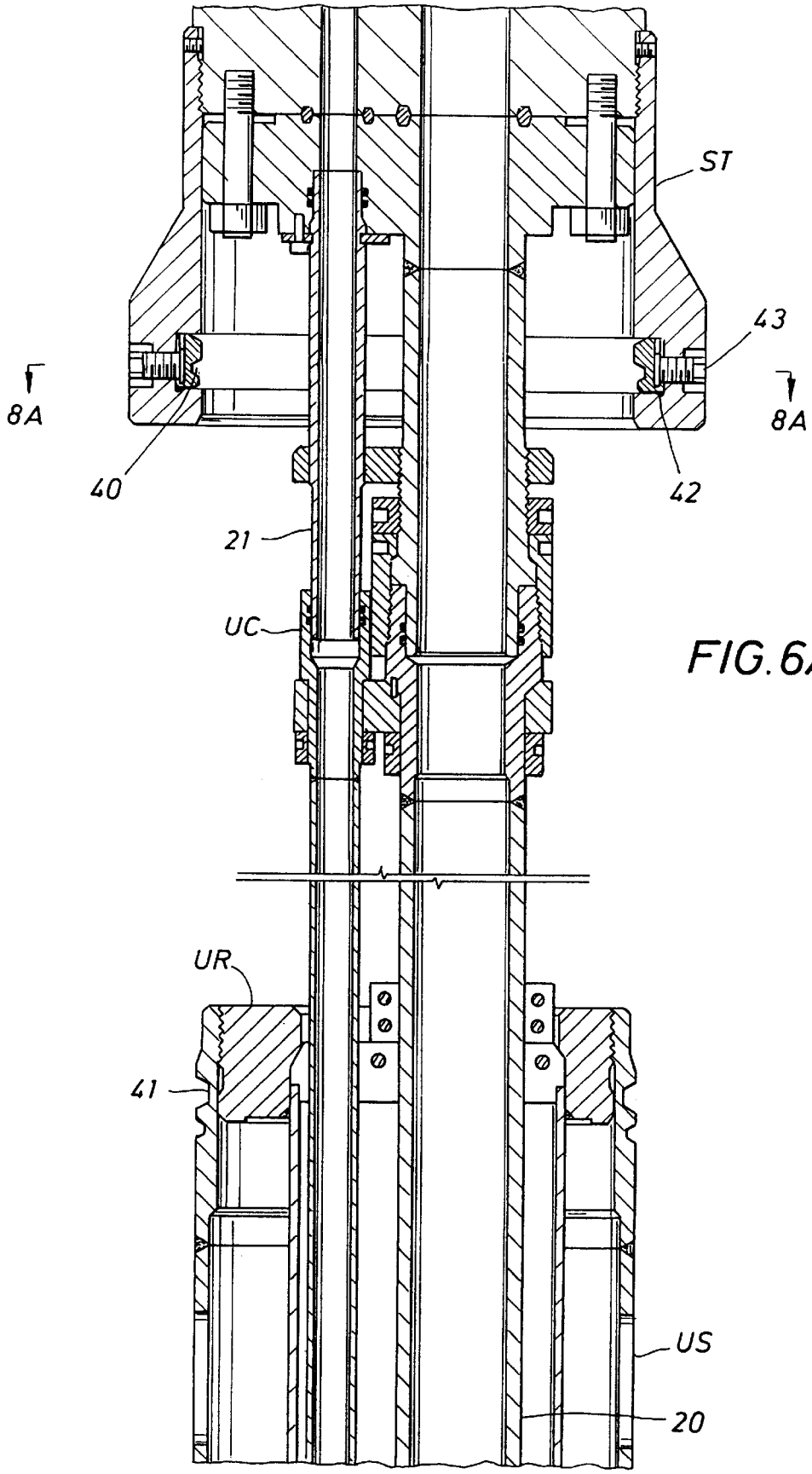
Figure 6B:
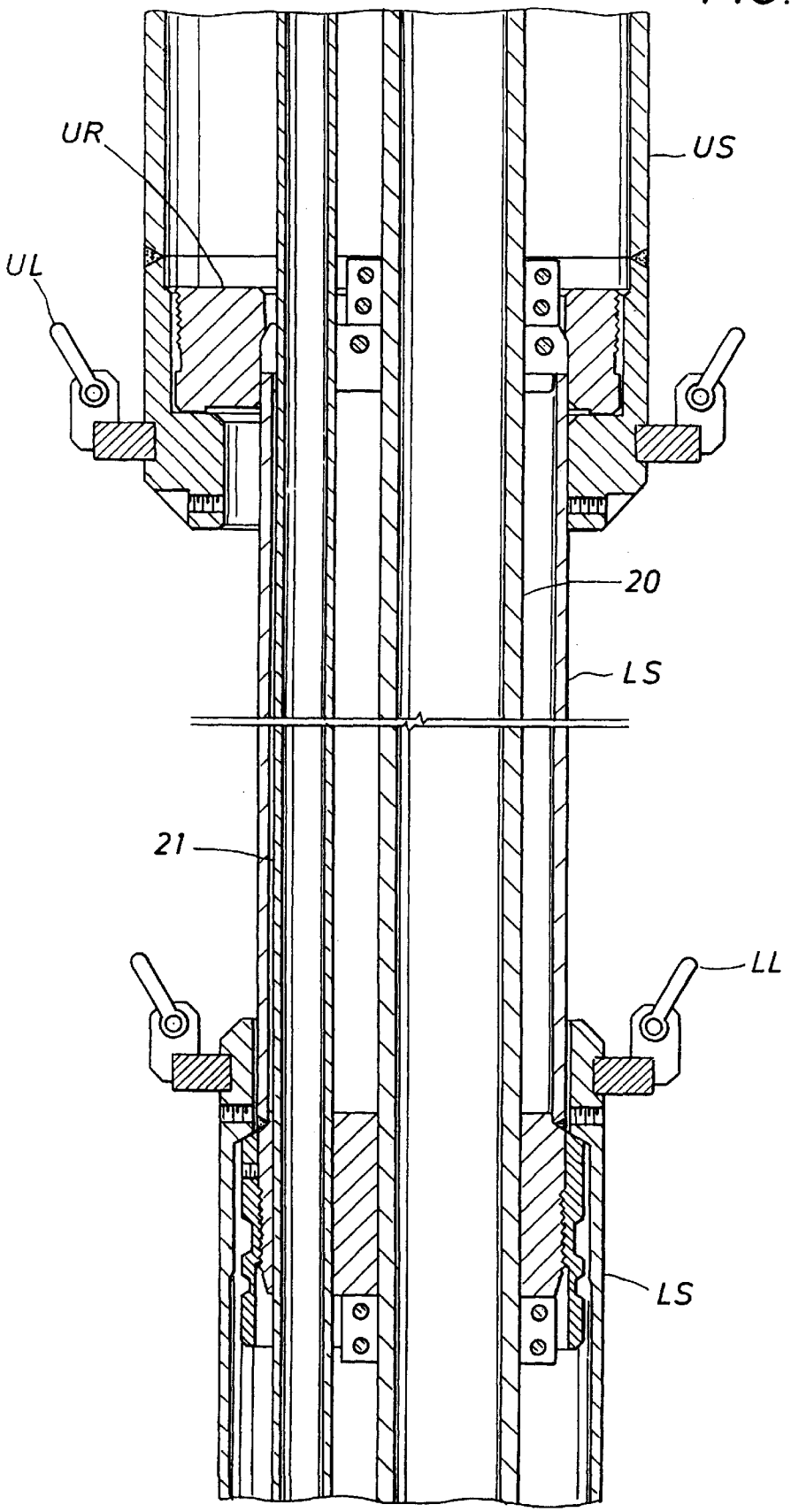
Figure 6B:
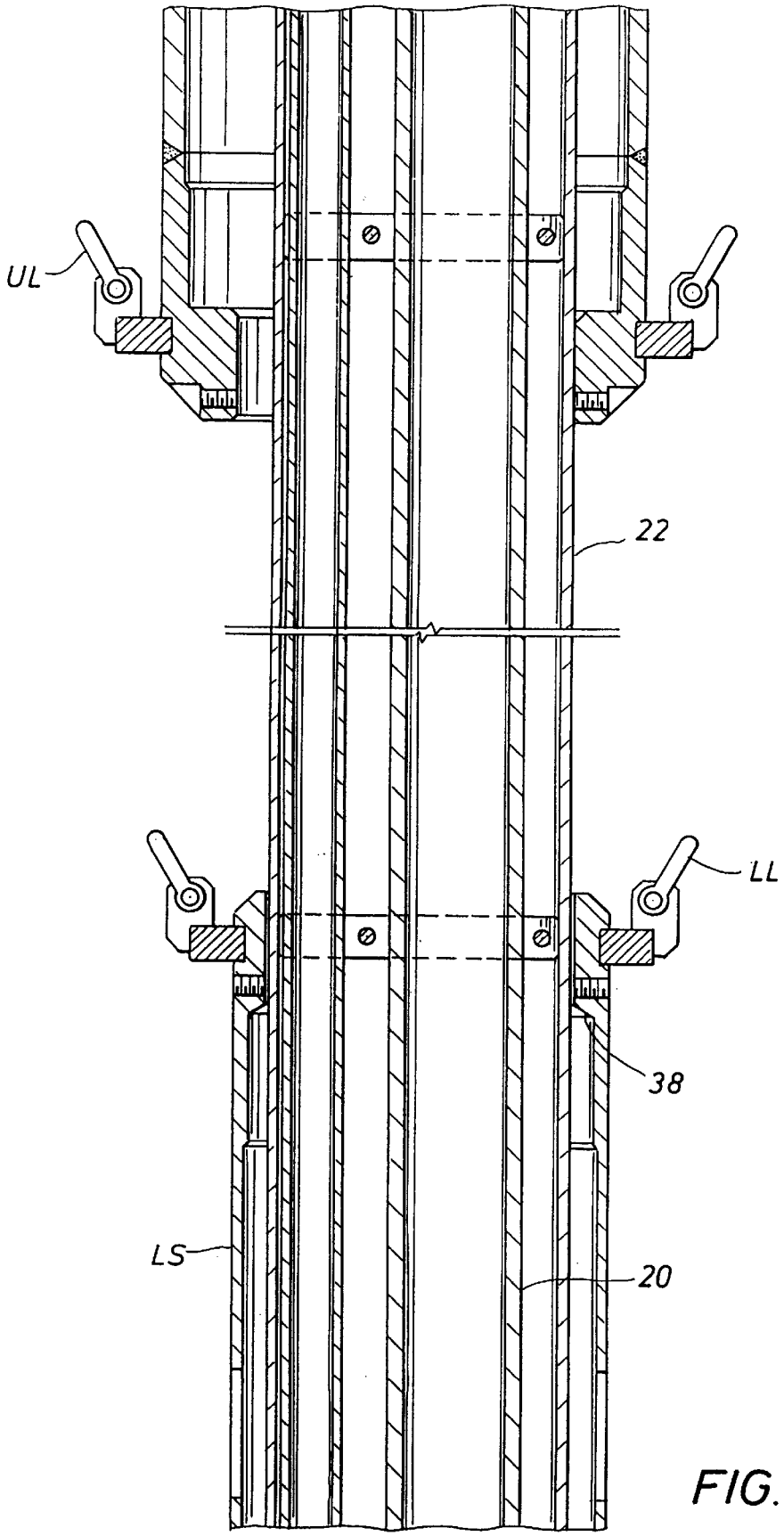
Figure 6C:
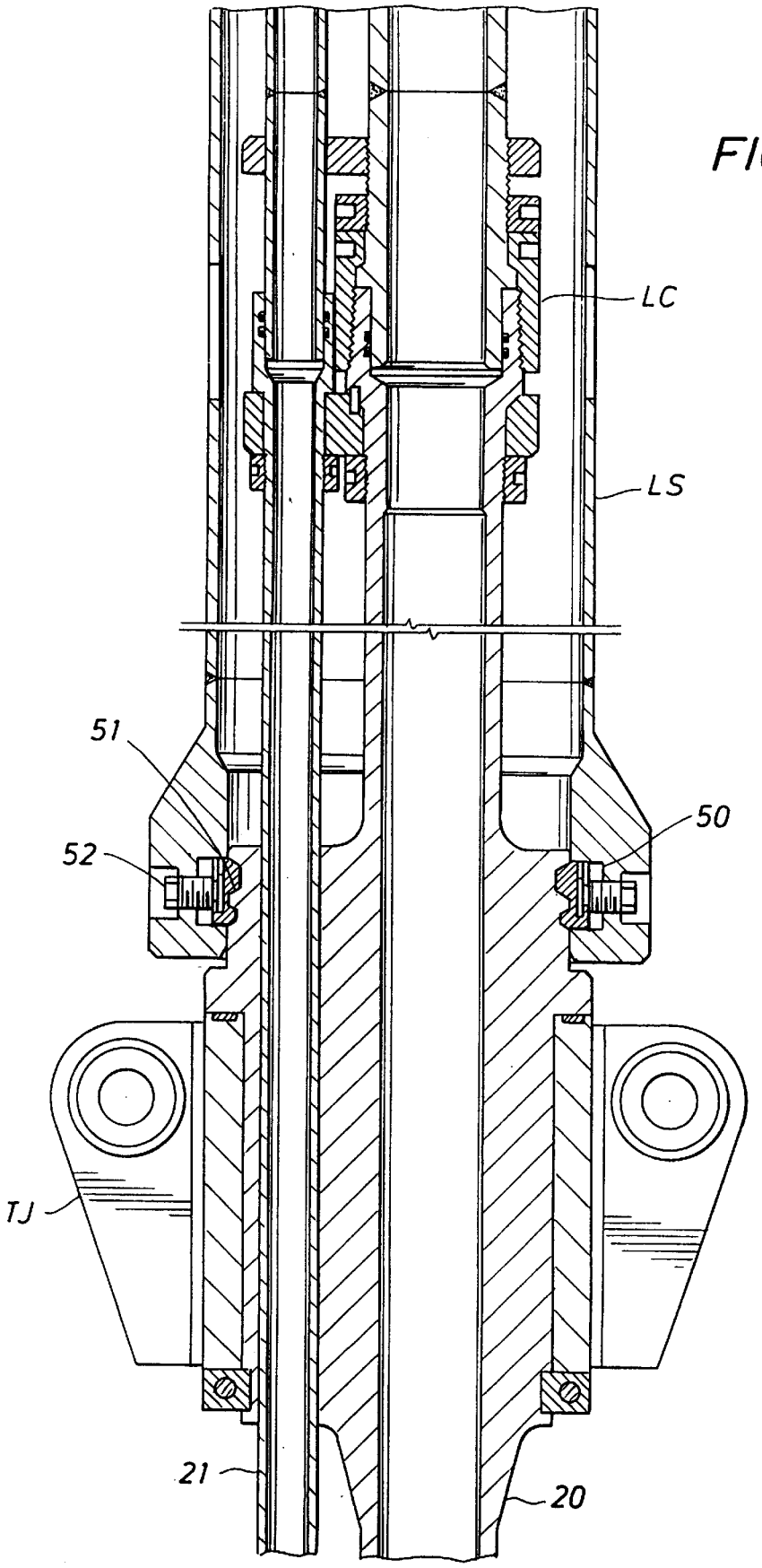
Figure 6C:
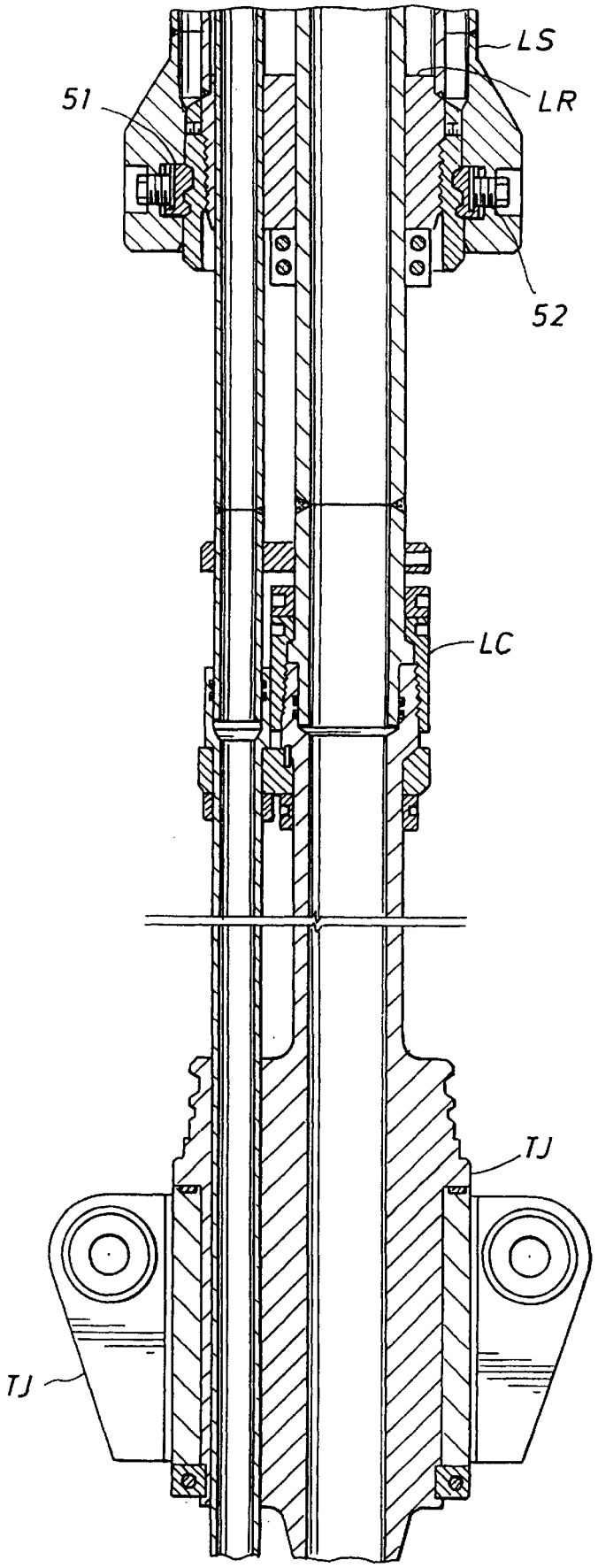
Figure 9A:
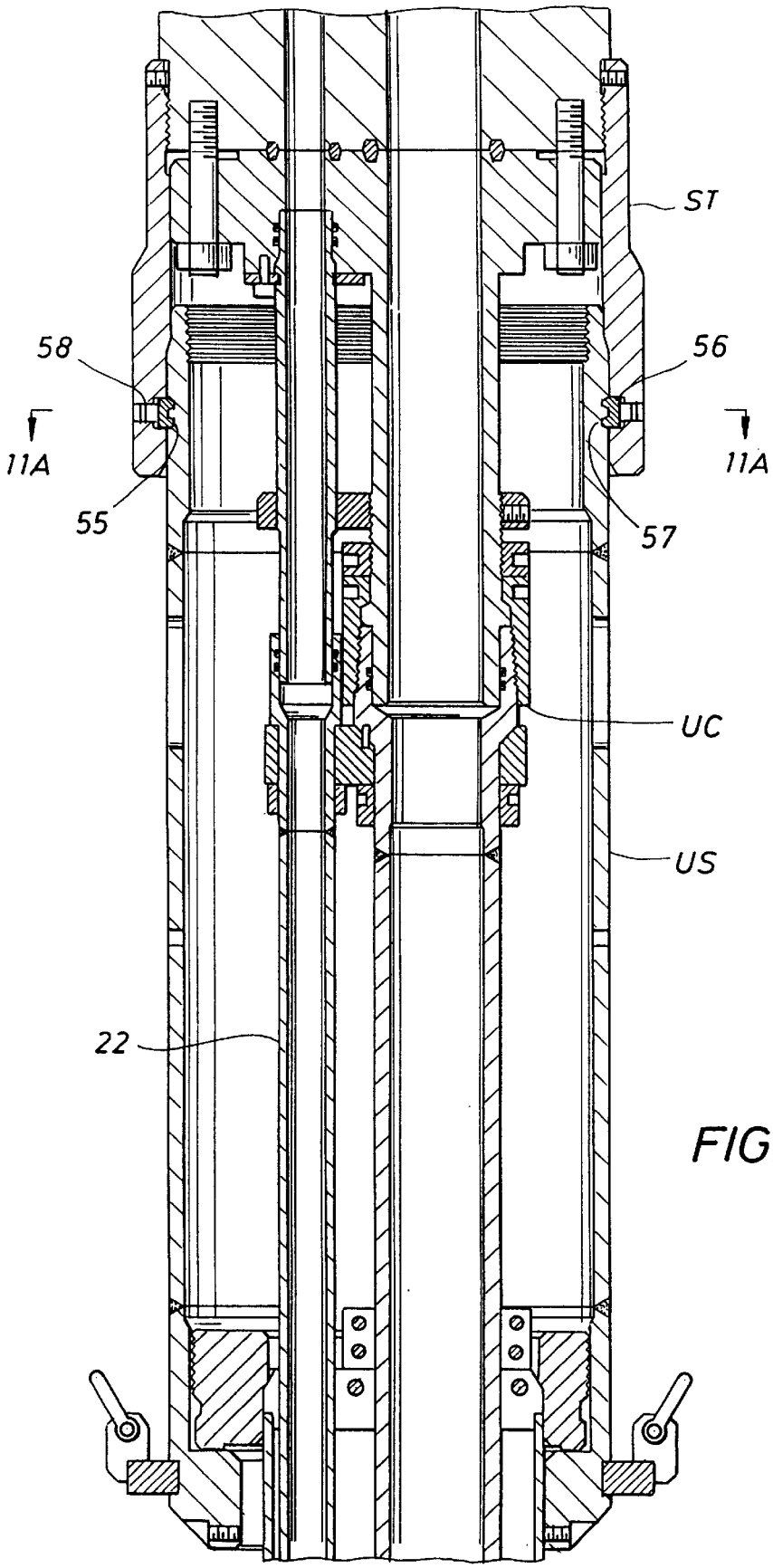
Figure 9B:
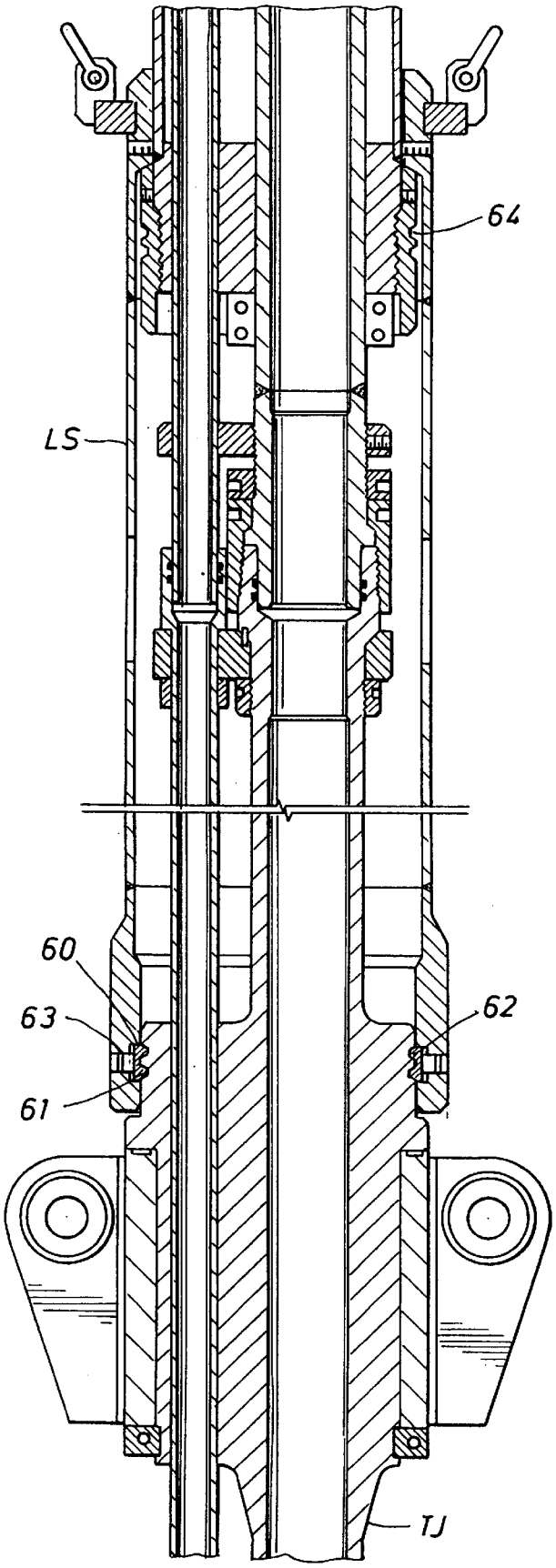
Figure 10A:
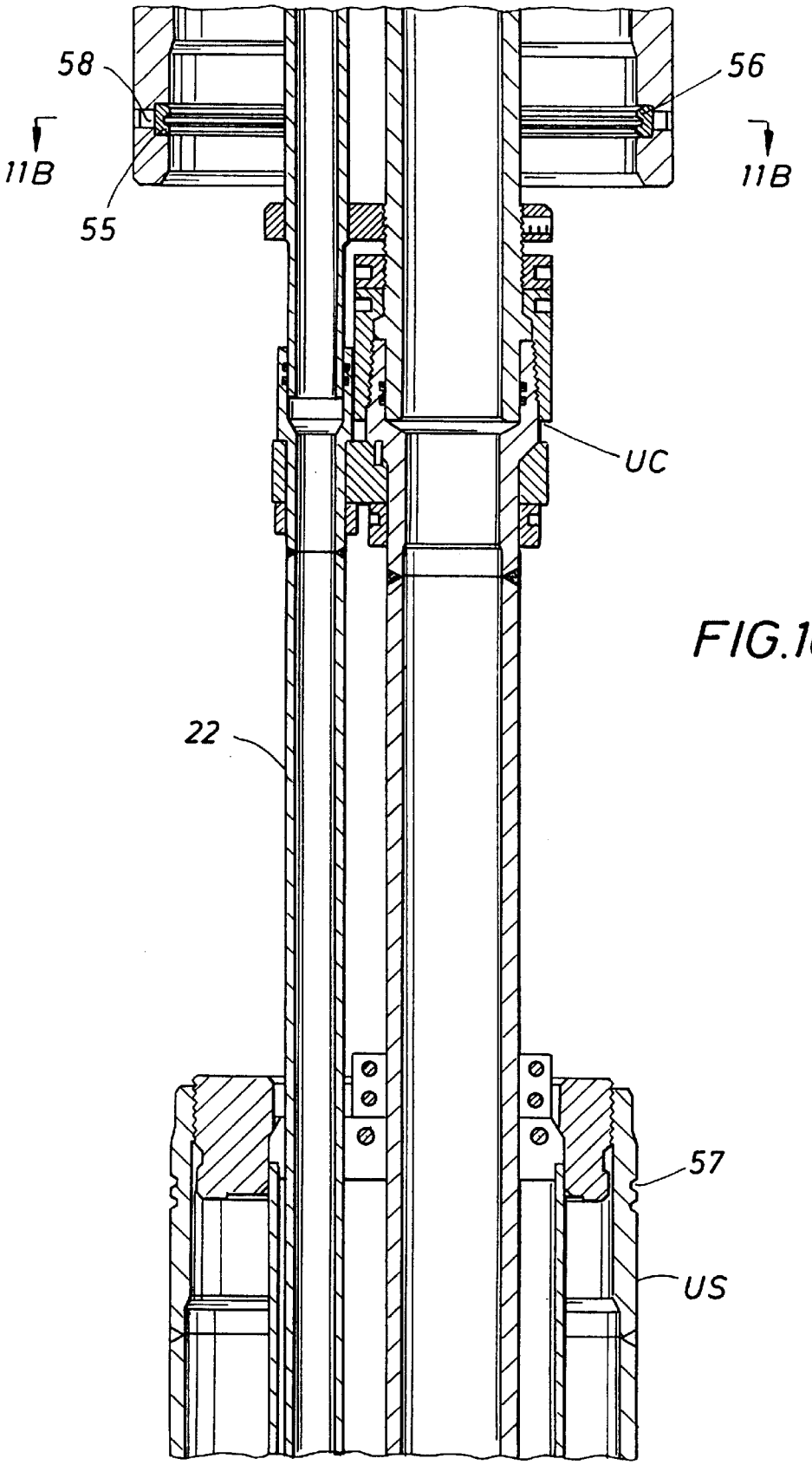
Figure 10B:
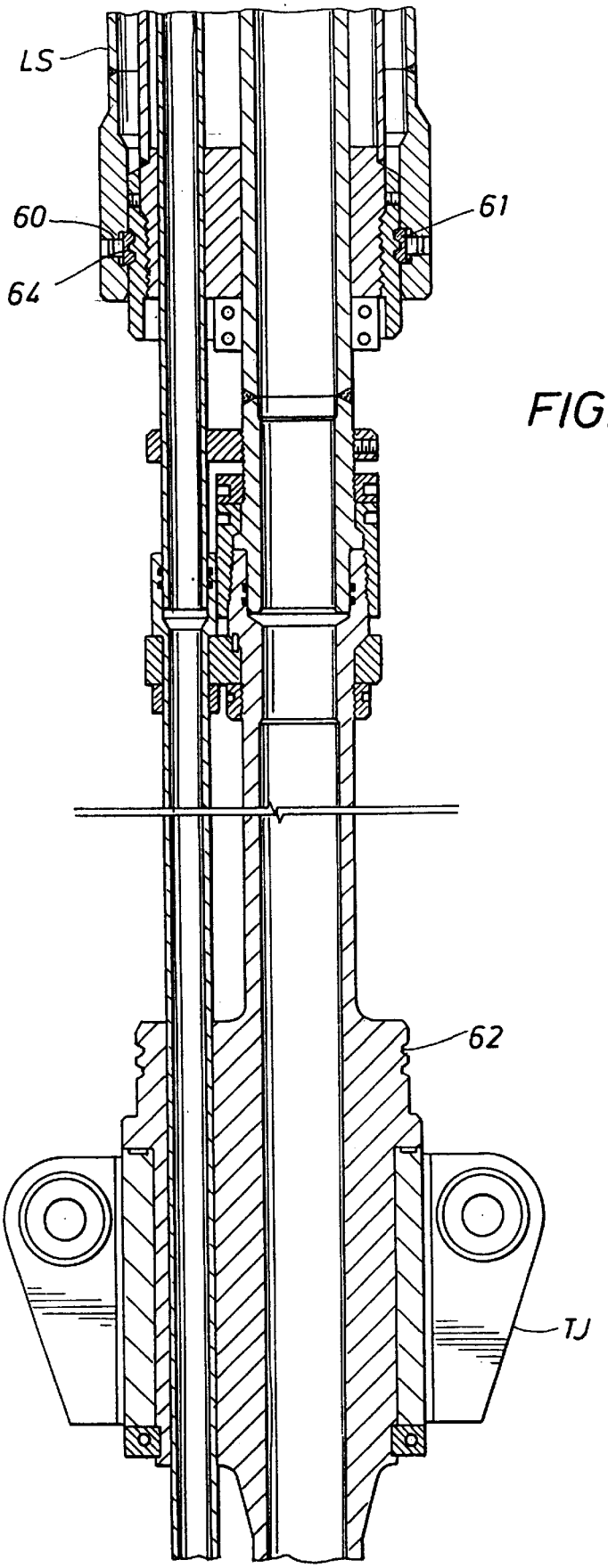

FIGS. 6A, 6B, and 6C are vertical sectional views, similar to FIGS. 3A, 3B, and 3C, of an alternative embodiment of the invention wherein the upper end of the upper sleeve is connected in its upper position by locking segments to the lower end of the surface tree and the lower end of the lower sleeve is releasably connected in its lower position by locking segments to the upper end of the tension joint;

FIGS. 6AA, 6BB and 6CC are vertical sectional views similar to FIGS. 6A, 6B and 6C, but in which the sleeve has been lowered to its lower position and the lower sleeve has been raised to its upper position;

FIGS. 7A and 8A are cross sectional views, as seen along broken lines 7A—7A of FIGS. 6A and 8A—8A of FIG. 6AA, of the locking segments and grooves in their locking and unlocking positions, respectively;

FIGS. 9A and 9B are partial vertical sectional views of another embodiment of the invention wherein the upper end of the upper sleeve and lower end of the lower sleeve are releasably connected to the lower end of the surface tree and upper end of the tension joint, respectively by split lock rings; and FIGS. 10A and 10B are partial sectional views similar to FIGS. 9A and 9B, but wherein the split lock rings have been withdrawn to permit the upper sleeve to be lowered to its lower position and the lower sleeve to be raised to its upper position; and FIGS. 11A and 11B are cross sectional vies as seen along broken lines 11A and 11B of FIGS. 9A and 10A, respectively, showing the split ring in its alternative positions.

Figure 1:
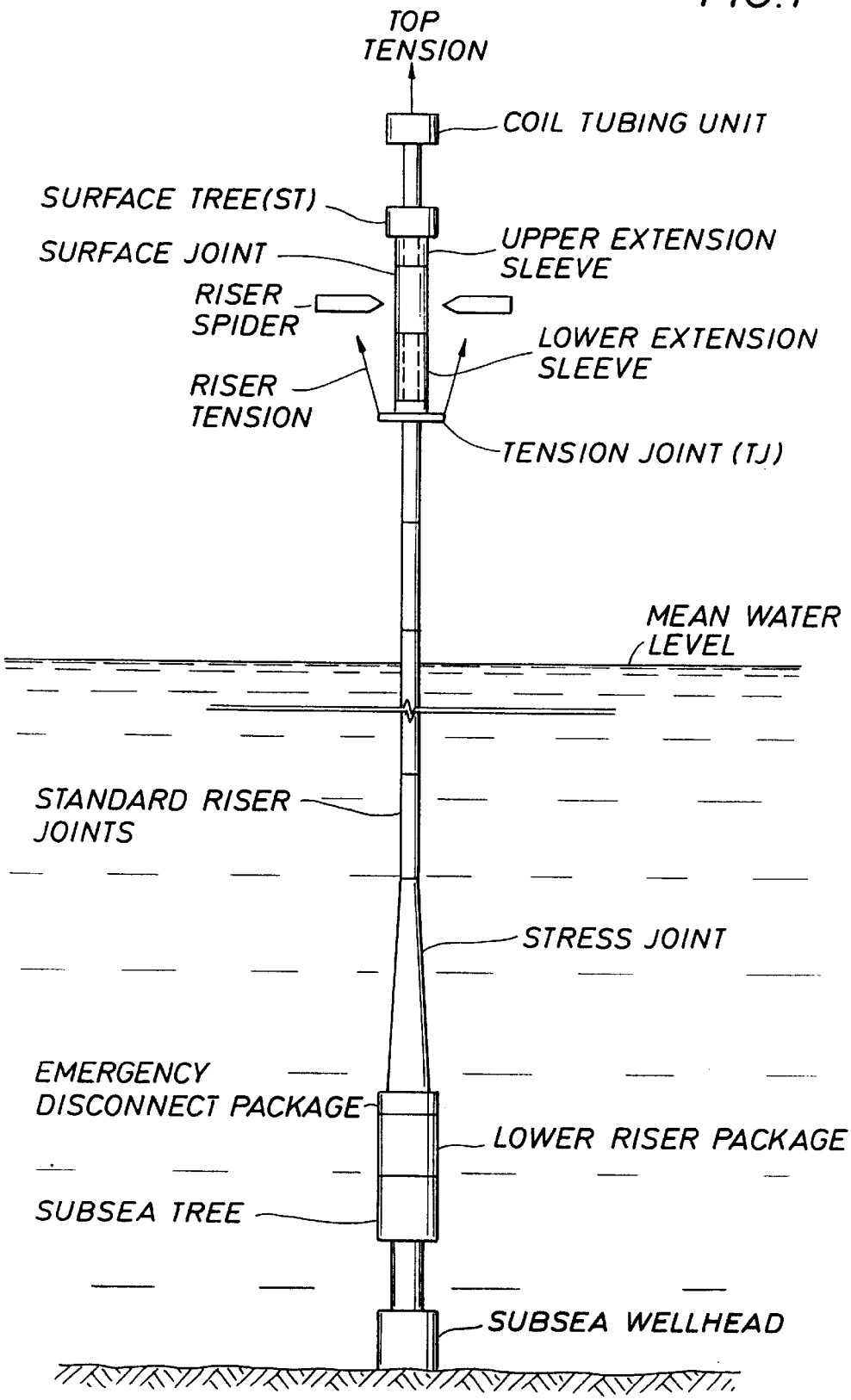

As indicated diagrammatically in FIG. 1, the surface joint (ST) of the upper riser section is so located as to extend through a spider on the rig floor, while the tension joint (TJ) is held in tension by lines extending to the vessel at the surface (not shown). As also shown diagrammatically in FIG. 1, the mean water level is normally below the lower end of the tension joint.

Figure 2A:
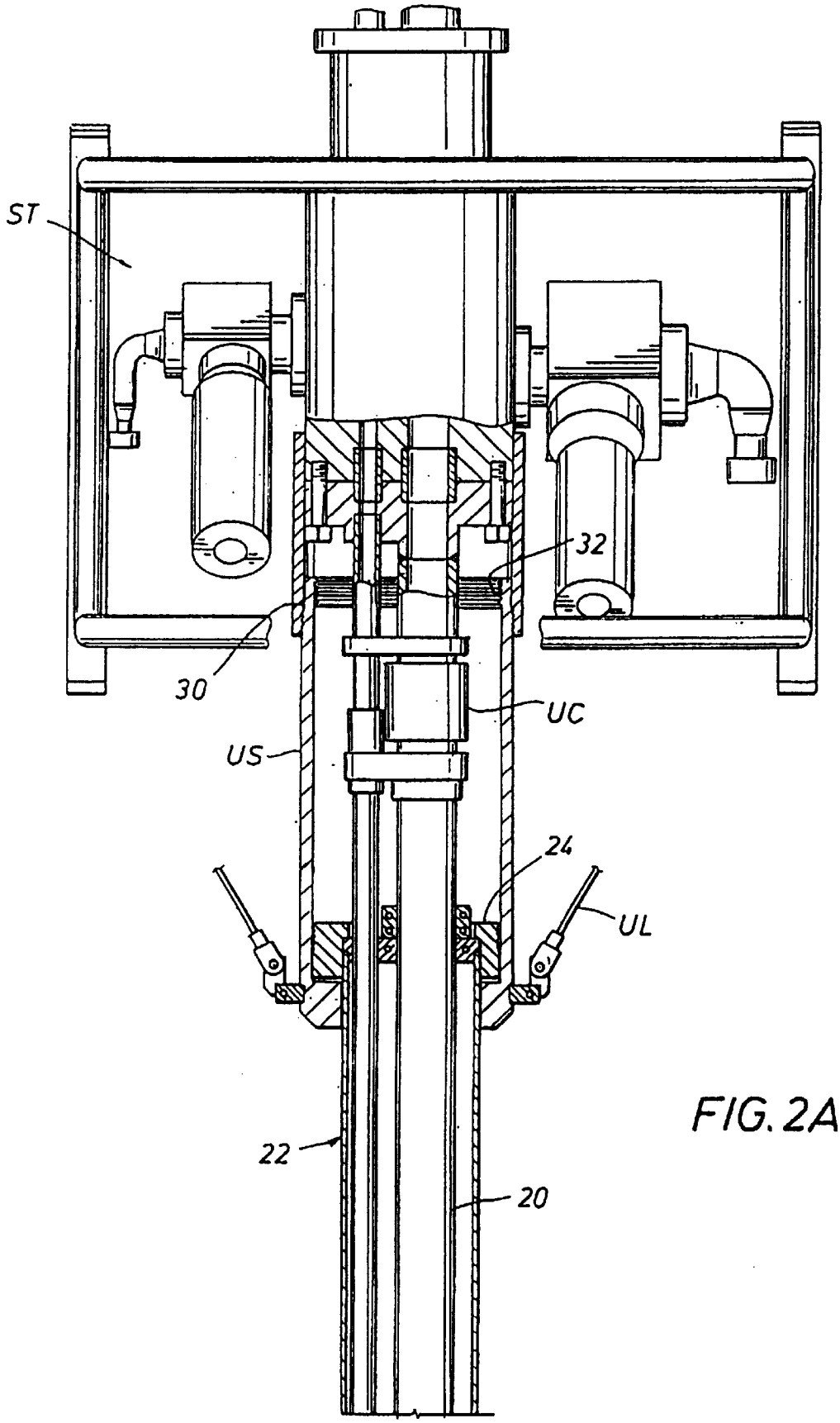
Figure 2A:
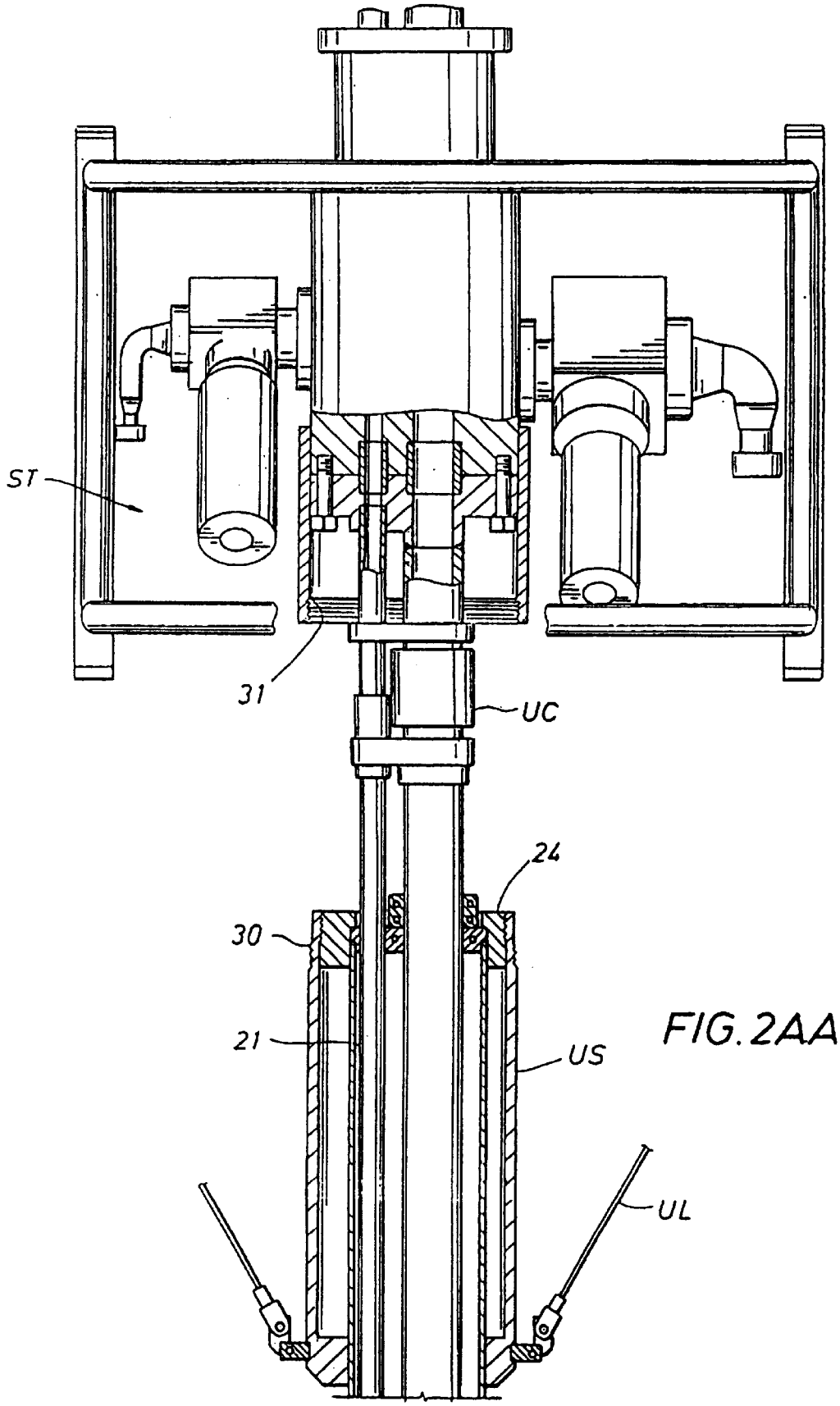
Figure 2B:
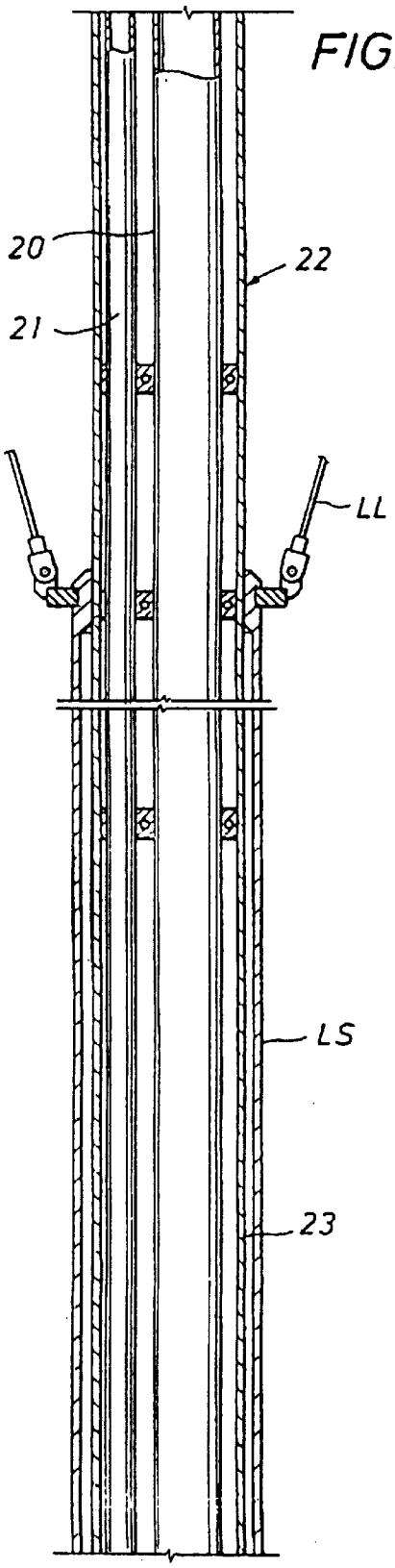
Figure 2B:
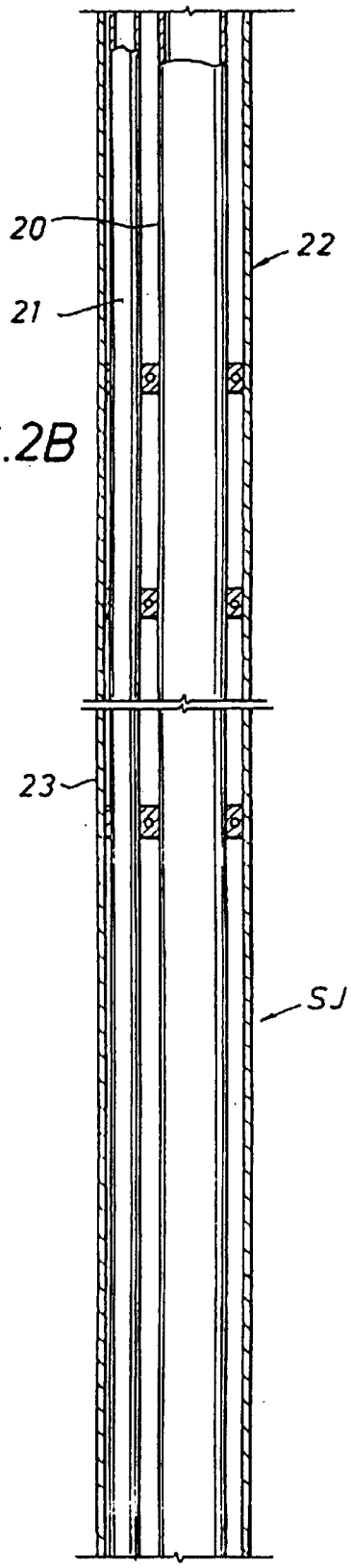
Figure 2C:
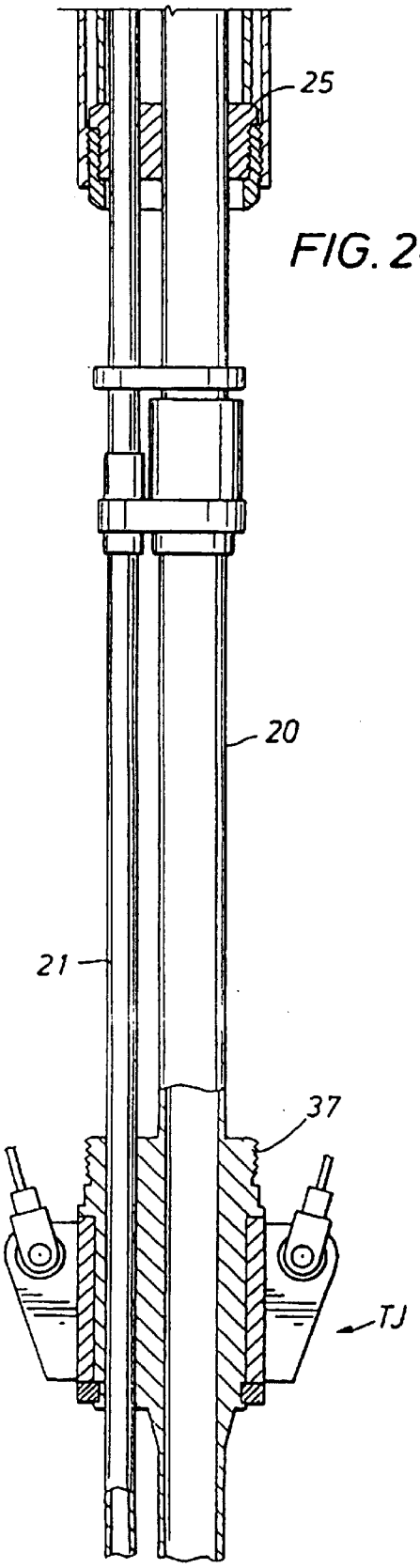
Figure 2C:
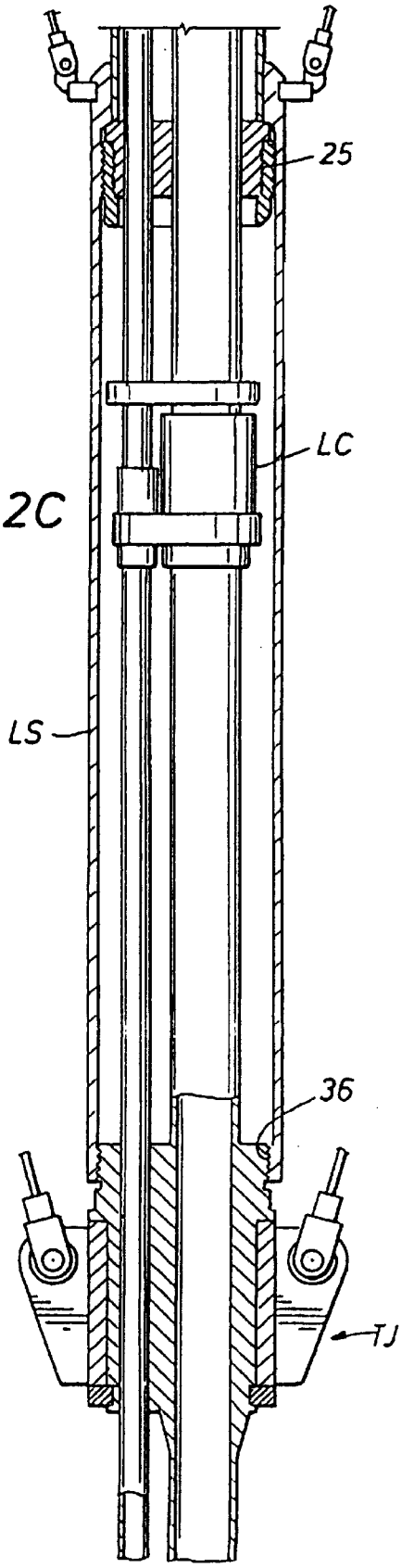

Referring to FIGS. 2A, 2B and 2C the upper riser system is shown to be connected between the lower end of surface tree ST on which the coil tubing unit is mounted and has a tension joint TJ at its lower end adapted to have its lower end connected to the upper end of the lower riser joint which extends downwardly to the stress joint mounted on the upper end of the lower riser package connected to the upper end of the subsea tree (see FIG. 1).

The upper riser section include a first pipe section 20 whose lower end is connected to the tubing hanger within the subsea wellhead for production fluid from the well tubing to the surface tree ST, and a second pipe section 21 extending along side the pipe section 20 and whose lower end is adapted for connection through the wellhead with the annulus between the tubing and casing strings of the well. The upper ends of the pipe sections 20 and 21 are connected to the lower end of the surface tree, which, as shown in FIG. 2A, has valved passageways for controlling the fluid flow through both pipes.

Thus, the upper ends of the pipe sections 20 and 21 are connected to conduits extending downwardly from the surface tree by means of an upper connector UC, and the lower ends of the sections are connected to upper tubular extensions of the tension joint TJ by means of a lower connector LC, although there may of course be other connectors within the conduits 20 and 21. In any case, the connectors UC and LC are of a type which are normally made up and/or disconnected above surface as the riser string is lowered into or raised from connection to the subsea wellhead.

Figure 4:
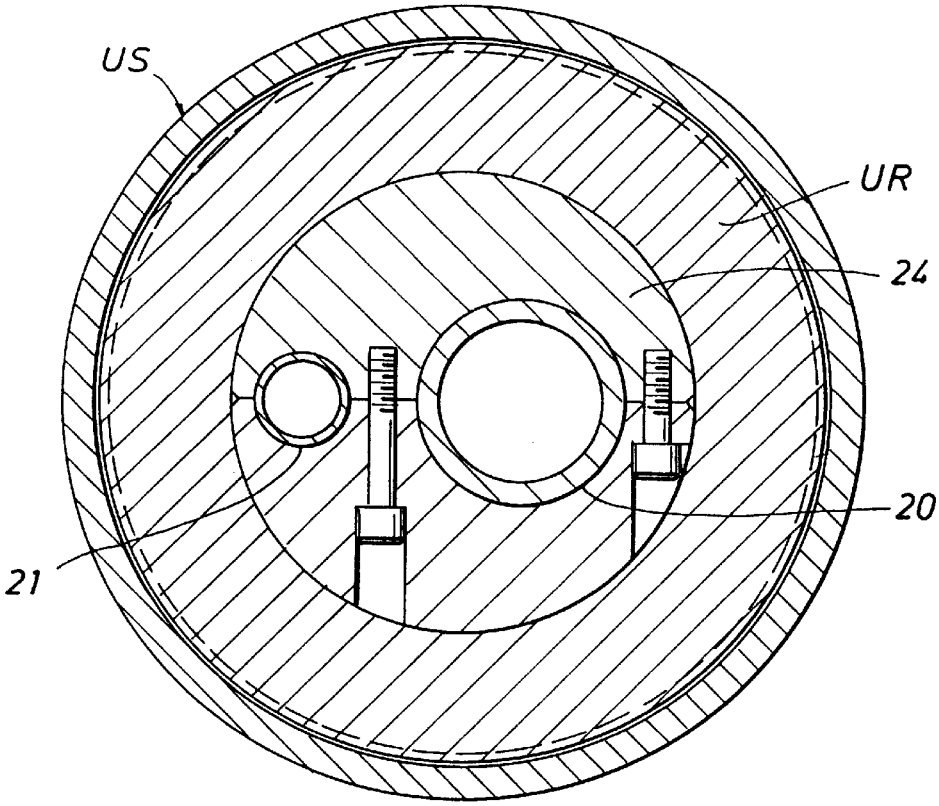
FIG. 4 is a cross-sectional view of the upper riser section as seen along broken lines 4—4 of FIG. 3B.
Figure 5:
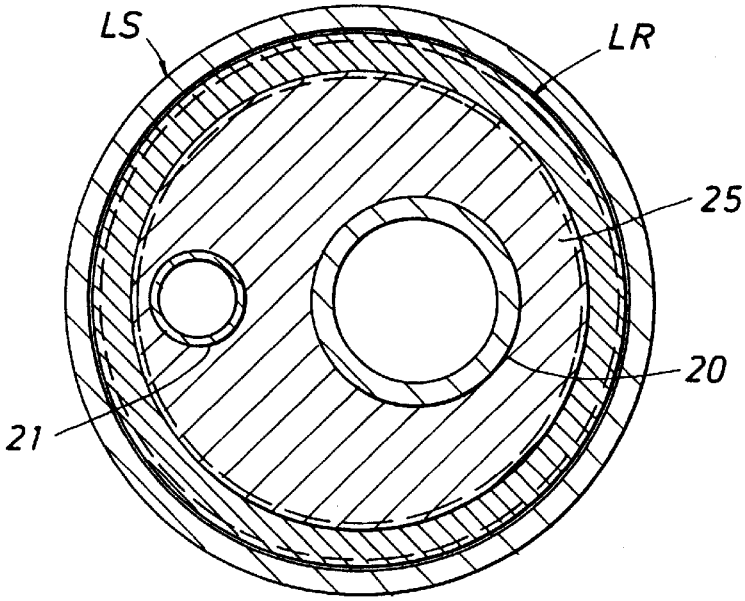
FIG. 5 is a cross-sectional view of the upper riser section as seen along broken lines 5—5 of FIG. 3B.

The riser pipe sections 20 and 21 are surrounded by a surface joint 22 which comprise a casing 23 having a head 24 at its upper head and a head 25 at its lower end, each head having holes to permit the riser sections to extend therethrough. More particularly, these heads, together with spacers along the length of the riser section, hold the conduits 20 and 21 in properly spaced relation. The heads are in turn connected to the conduits so as to be vertically supported from them in a position which, as previously indicated, extends through the rig floor, thus providing protection to the production and annulus conduits. To the extent above described, the illustrated apparatus is of generally conventional construction. As shown in FIG. 4, the upper head 24 is made of split sections adapted to be bolted to one another about the pipe sections 20 and 21.

In accordance with the novel aspects of the invention, however, an upper sleeve US is supported about the upper end of the surface joint, while a lower sleeve LS is supported on the lower end of the surface joint. More particularly, the upper sleeve is shiftable between positions in which its upper end is connected to the lower end of the surface tree ST to surround the upper connector UC and a lower position in which it surrounds the upper end of the surface joint beneath upper connector UC (see FIG. 2A). The lower sleeve is shown in FIG. 2C lowered for connection to the upper end of the tension joint TJ to surround the lower connector LC, and, in FIG. 2CC, with its lower end above lower connector LC.

As previously mentioned, in their upper and lower positions of FIGS. 2A and 2C, respectively, the upper and lower sleeves provide rigidity and resistance to cyclic bending moments which will greatly increase the fatigue life of the overall riser section. As shown in FIGS. 2AA and 2CC, the upper sleeve has been moved to a lower supported position, and the lower sleeve raised to an upper supported position in which access may be had to both the upper and lower connectors in the making up or breaking out of the riser section on the floor of the vessel.

The upper sleeve is raised and lowered by means of upper lines UL connected to a swivel on the lower end of the upper sleeve, and the lower sleeve is raised and lowered between its alternate positions by means of lower lines LL connected to a swivel on its lower end. Both lines are of course made up or let out at the surface level to shift the sleeves between their alternate positions, as will be described.

For this purpose, and as shown in FIGS. 3A and 3AA, and in FIGS. 3B and 3BB, an upper ring UR is mounted about the upper end of the upper head 24 of the surface joint 22, while a lower ring LR is mounted about the lower head 25 at the lower end of the surface joint. The lower end of the upper sleeve US and the upper end of the lower sleeve LS are open to extend freely over the upper and lower rings, respectively, as they are moved between their upper and lower positions. Thus, as shown, the inner diameters of the sleeves are such that with the upper ring above an inner flange of the lower end of the upper sleeve, the lower ring is beneath the upper end of the lower sleeve. The upper ring UR is welded to the upper end of the surface joint 22, while the lower ring LR is threadedly connected to the lower head 25.

The upper ring UR has threads 30 about its outer diameter, while the inner diameter of a lower tubular extension of the surface tree has threads 31 about its inner diameter. Threads 32 are formed about the inner diameter of the upper end of the upper sleeve US, and threads 33 are formed about its outer diameter beneath threads 32. As shown in FIG. 3A, with the upper sleeve shifted to its upper position, threads 33 may be made up with the threads 31 so as to connect it to and thus support it from the lower end of the surface tree in its raised position. As the upper sleeve is raised to this position, the flange at its lower end is adapted to engage the lower end of the upper ring UR. One or more openings or windows 0 are formed in the upper sleeve so as to be positioned opposite the upper connector UC and thus provide visual access to it when the upper sleeve is in its upper position.

As shown in FIGS. 3B and 3CC, the lower ring LR is threadedly connected about the lower head 25 of the surface joint, and has threads 35 about its outer diameter. Threads 36 are formed about the inner diameter of the lower end of the lower sleeve for threaded connection with threads 37 formed about the upper end of the tension joint TJ when the lower sleeve is lowered and made up therewith. In this lowered position, a downwardly facing shoulder 38 on the flange at the upper end of the lower sleeve engages a shoulder 39 at the upper end of the ring LR as the threads in the lower end of the sleeve and upper end of the tension joint are made up. As in the case of the upper sleeve, the lower sleeve has one or more openings O to permit visual access to the lower connector LC. As the lower sleeve LS is shifted to its upper position (FIG. 3CC), the threads 36 about its lower end are made up with threads 35 about the lower rim LR thereby supporting the lower sleeve in its upper position.

As previously described, the removability of upper ring UR is useful in the assembly of the upper sleeve over the surface joint. On the other hand, the removability of the LR reduces the outer diameter of the lower end of the joint to permit the sleeve to be replaced with one of smaller O.D, all for reasons previously discussed.

The embodiment of the invention illustrated in FIGS. 6A to 6C and 6AA to 6CC, as well as FIGS. 7A and 8A, is identical to the previously described embodiment except for the manner in which the upper and lower sleeves are locked in their upper and lower positions, respectively. Thus, corresponding parts of the second embodiment are indicated with the same reference characters as in the first embodiment. Each of the upper and lower sleeves US and LS of the second embodiment are locked in their upper and lower positions, respectively, by means of circumferentially spaced locking segments 40, rather than threads as in the case of the first embodiment. Thus, the upper end of the upper sleeve US has grooves 41 thereabout adapted to receive teeth or ribs on the inner sides of locking segments 40, which are carried within an annular recess 42 about the enlarged outer diameter portion at the lower end of the surface tree ST. More particularly, the locking segments are moved from their outer unlocked positions, to permit the upper sleeve to be moved to its lower position, to locking positions within the grooves about the upper end of the upper sleeve, by means of bolts 43 which are threadedly received within holes 44 connecting the recess with the outer diameter of the lower end of the surface tree. More particularly, as shown in FIGS. 7A and 8A, the outer ends of the bolts have flanged heads 45 received within slots on the outer ends of the segments, whereby the outer ends of the bolts may be manipulated to move the locking segments into and out of locking position. As shown, the segments are of such size and so spaced apart as to permit their free movement between locking and unlocking positions.

As described, and shown in FIGS. 6C and 6CC, a similar locking arrangement is provided for supporting the lower sleeve LS to its lowered position. Thus, as in the case of the upper locking mechanism, there is an annular groove 50 about an enlarged diameter portion of the lower end of the lower sleeve which receives circumferentially spaced apart locking segments 51 as they are moved into and out of grooves 53 in the tension joint TJ by means of locking screws 52 extending through threaded holes connecting with the recess. The locking segments are of course withdrawn from the grooves 53 to permit the lower sleeve to be raised to its upper position (FIG. 6CC) to permit visual access to the lower connector, and then subsequently lowered back for relocking to the upper end of the tension joint, as shown in FIG. 6C.

The further embodiment of the invention shown in FIGS. 9A and 9B as well as FIGS. 10A and 10B, and the cross sectional views of FIGS. 11A and 11B, differs from that of FIGS. 6A–6C and 6AA–6CC only in that the locking means comprises a split ring 55 carried within a recess 56 about the inner diameter of the lower end of the surface tree ST for movement into and out of grooves 57 in the upper sleeve US to permit the sleeve to move into and out of locking position. The split ring is normally biased outwardly to its unlocking position, but is moved inwardly to locking position by means of screws 58 threadedly received in openings connecting with the recess 57. Since the lock ring normally moves toward its outer position, it is not necessary to withdraw it by means of a flange in the inner end of the screws. When the upper sleeve is moved to its upper position, as shown in FIG. 9A, it may be locked to the ring about the joint, as in the prior embodiment.

As shown in FIGS. 9B and 10B, a similar split ring 60 is carried within a recess 61 about the inner diameter of the lower end of the lower sleeve LS for movement between the normally retracted position and the inward position to engage in a groove 62 about the upper end of the tension joint. As in the case of the upper ring, the normally expanded split ring 60 is moved inwardly by a screw 63 threaded to a hole in the outer end of recess 61, and is free to expand into the recess 61 when the screw is backed off. When the lower sleeve LS is raised to its upper position of FIG. 10B, its split ring is disposed opposite a groove 64 in the lower end of the lower sleeve.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope if the claims.

Because many possible embodiments may be made of the invention without departing from the scope thereof, it is to be understood that all matters herein set forth or shown in the accompanying drawings is to be interpreted as illustrative and not in a limiting sense.

What is claimed is:

1. An apparatus for use in the completion and workover of a subsea well adapted for coil tubing intervention, comprising a surface tree having an upper end on which a coil tubing injection unit may be mounted, a tension joint adapted to be connected to the upper end of a lower riser section extending to a subsea tree and to be suspended from a tensioning system at the surface to enable the lower riser section to be maintained in tension, an upper riser section for connection at its upper end to the surface tree and at its lower end to the tension joint, and a surface joint mounted on and surrounding the upper riser section in position to extend through the spider at the floor of an offshore rig, said upper riser section including an upper portion having an upper connector intermediate the surface tree and surface joint and a lower portion having a lower connector intermediate the surface joint and tension joint, an upper sleeve carried about the surface joint for shifting between a lower position in which access may be had to the upper riser connector and an upper position extending between the surface joint and surface tree to surround the upper riser portion, and a lower sleeve carried about the surface joint for shifting between an upper position in which access may be had to the lower riser connector and a lower position extending between the surface joint and tension joint to surround the lower riser portion.

2. As in claim 1, including means on the upper end of the upper sleeve and lower end of the surface tree for supporting the upper sleeve in its upper position and on the upper end of the upper sleeve and upper end of the surface joint for supporting the upper sleeve in its lower position, and means on the lower end of the lower sleeve and upper end of the tension joint for supporting the lower sleeve in its lower position and on the lower end of the lower sleeve and lower end of the surface joint for supporting the lower sleeve in its upper position.

3. As in claim 2, wherein the means for supporting the upper sleeve in its upper position comprises threads on the upper sleeve engagable with threads on the surface tree, and the means for supporting the upper sleeve in its lower position comprises threads on the upper sleeve engagable with threads on the surface joint.

4. As in claim 2, wherein the means for supporting the lower sleeve in its lower position comprises threads on the lower sleeve engagable with threads on the tension joint, and the means for supporting the lower sleeve in the upper position comprises threads on the lower sleeve engagable with threads on the surface joint.

5. As in claim 3, wherein the means for supporting the lower sleeve in its lower position comprises threads on the lower sleeve engagable with threads on the tension joint, and the means for supporting the lower sleeve in the upper position comprises threads on the lower sleeve engagable with threads on the surface joint.

6. As in claim 5, wherein the threads on the upper end of the upper sleeve are formed on its inner and outer diameters for engagement with threads on the surface joint and surface tree, respectively.

7. As in claim 5, wherein the means for supporting the lower sleeve in its lower position also comprises a shoulder on the upper end of the lower sleeve for seating on a shoulder on the lower end of the surface tree as the threads on its lower end are made up with threads on the tension joint.

8. As in claim 2, wherein the means for supporting the upper sleeve in its upper position comprises radially expandable and contractible locking means carried by the surface tree and grooves in the sleeve to receive the locking means, and the means for supporting the upper sleeve in its lower position comprises threads on the upper sleeve engagable with threads on the surface joint.

9. As in claim 2, wherein the means for supporting the lower sleeve in its lower position comprises radially and expandable and contractible locking means carried by the lower sleeve and a groove in the tension joint to receive the locking means, and the means for supporting the lower sleeve in its upper position comprises threads on the sleeve engagable with threads on the surface joint.

10. As in claim 8, wherein the means for supporting the lower sleeve in its lower position comprises radially and expandable and contractible locking means carried by the lower sleeve and grooves in the tension joint to receive the locking means, and the means for supporting the lower sleeve in its upper position comprises threads on the sleeve engagable with threads on the surface joint.

11. As in claim 10, wherein the means for supporting the lower sleeve in its lower position also comprises a shoulder on the lower sleeve for seating on a shoulder on the surface joint as the threads on its lower end are made up with the threads on the tension joint.

12. As in any one of claims 8, 9, or 10, wherein locking means comprises circumferentially spaced segments.

13. As in any one of claims 8, 9, and 10, wherein locking means comprises a split ring.

14. As in claims 5 or 9, wherein the surface joint comprises a tubular member having a head fixed to each end through which the riser section extends and a ring releasably connected to the outside of each head and on which the threads thereabout for threaded engagement with one of the sleeves.

15. As in claim 1, wherein the upper sleeve has means on its lower end to which a lifting line may be attached, and the lower sleeve has means on its upper end to which a lowering line may be attached.

16. As in claim 15, wherein the lower end of the upper sleeve has a collar to which the line may be attached in order to lift the upper sleeve into engagement with the lower end of the upper ring, and the upper end of the lower sleeve has a collar to which the line may be attached in order to lower the lower sleeve onto the upper end of the lower ring.

17. As in claim 1, wherein, the upper sleeve has an opening through which access may be had to the upper connection in its upper position, and the lower sleeve has an opening through which access may be had to the lower connection in its lower position.

18. As in claim 1, wherein the upper riser section includes a pipe section for connection with the well tubing.

19. As in claim 18, wherein the upper riser section also includes a pipe section parallel to the first mentioned pipe section for connection with the tubing/casing annulus.

20. As in claim 2, wherein the means for supporting the lower sleeve on its upper position comprises a head which surrounds the upper riser section on the lower end of the surface joint, a ring mounted about the head, and means about the ring and lower end of the sleeve for releasably connecting them to one another, said ring being removable from the body to enable the upper end of an alternative lower sleeve to be releasably connected to the body.

* * * * *